US012215412B2

(12) United States Patent
Von Czarnowski et al.

(10) Patent No.: US 12,215,412 B2
(45) Date of Patent: Feb. 4, 2025

(54) METHOD AND SYSTEM FOR HEAT TREATMENT OF METAL ALLOY SHEET

(71) Applicant: ELKEME Hellenic Research Centre for Metals S.A., Athens (GR)

(72) Inventors: Peter Von Czarnowski, West Bloomfield, MI (US); Armin Von Czarnowski, Orchard Lake, MI (US)

(73) Assignee: ELKEME Hellenic Research Centre for Metals S.A., Athens (GR)

( * ) Notice: Subject to any disclaimer, the term of this patent is extended or adjusted under 35 U.S.C. 154(b) by 599 days.

(21) Appl. No.: 17/312,253

(22) PCT Filed: Dec. 12, 2019

(86) PCT No.: PCT/US2019/065984

§ 371 (c)(1),
(2) Date: Jun. 9, 2021

(87) PCT Pub. No.: WO2020/123807

PCT Pub. Date: Jun. 18, 2020

(65) Prior Publication Data

US 2022/0033945 A1 Feb. 3, 2022

Related U.S. Application Data

(60) Provisional application No. 62/794,881, filed on Jan. 21, 2019, provisional application No. 62/787,663,
(Continued)

(51) Int. Cl.
*C22F 1/04* (2006.01)
*C21D 9/00* (2006.01)
(Continued)

(52) U.S. Cl.
CPC ..... *C22F 1/04* (2013.01); *C21D 9/0006* (2013.01); *C21D 9/46* (2013.01); *C22C 21/00* (2013.01); *C22F 1/002* (2013.01)

(58) Field of Classification Search
None
See application file for complete search history.

(56) References Cited

U.S. PATENT DOCUMENTS 3,988,216 A * 10/1976 Austin ..... C25D 5/028 205/147
5,356,495 A * 10/1994 Wyatt-Mair ..... C22C 21/06 164/462
(Continued)

FOREIGN PATENT DOCUMENTS

DE 881737 7/1953
EP 3406744 11/2018
(Continued)

OTHER PUBLICATIONS

Extended Search Report for European Patent Application No. 19896075.9, dated Jul. 21, 2022 8 pages.
(Continued)

*Primary Examiner* — George Wyszomierski
(74) *Attorney, Agent, or Firm* — Sheridan Ross, P.C.

(57) ABSTRACT

A method and system solution heat treat, at an elevated first temperature, a coil of aluminum alloy sheet to form a heat-treated coil and while at least a portion of the heat-treated coil is being solution heat treated, uncoil a heat-treated portion of the aluminum alloy sheet from the heat-treated coil and continuously quenching the uncoiled heat-treated portion to form a quenched sheet.

20 Claims, 14 Drawing Sheets

Related U.S. Application Data filed on Jan. 2, 2019, provisional application No. 62/778,739, filed on Dec. 12, 2018.

(51) Int. Cl.

| | |
|---|---|
| ***C21D 9/46*** | (2006.01) |
| ***C22C 21/00*** | (2006.01) |
| ***C22F 1/00*** | (2006.01) |

(56) References Cited

U.S. PATENT DOCUMENTS

| | | | | |
|---|---|---|---|---|
| 5,362,341 | A * | 11/1994 | Palmer | C22F 1/047 148/692 |
| 6,221,185 | B1 | 4/2001 | Tanzmann et al. | |
| 6,264,767 | B1 | 7/2001 | Frank et al. | |
| 2015/0240339 | A1 | 8/2015 | Danyo et al. | |
| 2017/0253953 | A1 | 9/2017 | Meyer et al. | |
| 2018/0117650 | A1 | 5/2018 | Felberbaum et al. | |

FOREIGN PATENT DOCUMENTS

| | | |
|---|---|---|
| FR | 1441155 | 6/1966 |
| WO | WO 92/21454 | 12/1992 |

OTHER PUBLICATIONS

International Search Report and Written Opinion for International (PCT) Patent Application No. PCT/US19/65984, dated Apr. 16, 2020 11 pages.

International Preliminary Report on Patentability for International (PCT) Patent Application No. PCT/US2019/065984, dated Jun. 24, 2021 9 pages.

Official Action for European Patent Application No. 19896075.9, dated Jul. 14, 2023 7 pages.

* cited by examiner

METHOD AND SYSTEM FOR HEAT TREATMENT OF METAL ALLOY SHEET

CROSS REFERENCE TO RELATED APPLICATIONS

This application is a national stage application under 35 U.S.C. 371 and claims the benefit of PCT Application No. PCT/US2019/065984 having an international filing date of 12 Dec. 2019, which designated the United States, and which PCT application claimed the benefit of U.S. Provisional Application Ser. No. 62/778,739, filed Dec. 12, 2018; 62/787,663, filed Jan. 2, 2019; and 62/794,881, filed Jan. 21, 2019, each entitled "Method and System for Heat Treatment of Metal Alloy Sheet" the contents of which are incorporated herein by reference in their entireties.

FIELD

The disclosure relates generally to solution heat treatment of metal alloys and particularly to solution heat treatment and annealing of aluminum alloys.

BACKGROUND

Aluminum sheet products are used in a wide range of applications including the automotive, commercial transportation, aerospace, consumer electronics, building & construction as well as packaging industries.

The physical properties revealed by an aluminum alloy in flat rolled products form (FRP) and components made from Al-FRP are significantly influenced by the alloy composition and the heat treatment. Properties affected by the production process include mechanical strength, fatigue properties, thermal stability, formability, corrosion resistance, electrical & thermal properties, joinability, and surface quality, for example. As used herein, the terms "sheet" or "strip" generally refers to rolled products without limitation to a particular gauge. The term includes typical foil gauges as well as conventional sheet gauges up to gauges typically formed as a plate.

The terms "heat treating" or "heat treatment" generally refer to any of the heating and cooling operations that are performed for the purpose of changing the above described properties, specifically strength, the metallurgical microstructure, morphology of particles and phases or the residual stress state of a metal product. When the term is applied to aluminum alloys, its use is frequently restricted to the specific operations employed to increase strength and hardness of the precipitation-hardened wrought and cast alloys. These usually are referred to as the "heat-treatable alloys" to distinguish them from so-called "non-heat-treatable" alloys in which no significant strengthening can be achieved by heating and cooling.

Heat treatable alloys are strengthened by solution heat treatment (SHT) and controlled aging and include, but are not limited to, the 2XXX, some 4XXX, 6XXX and 7XXX series alloys, according to the Aluminum Association alloy designation system. In contrast, non-heat-treatable wrought alloys typically derive their strength from solid solution or dispersion hardening and are further strengthened by strain hardening. They include, but are not limited to, the 1XXX, 3XXX, 4XXX, and 5XXX series alloys.

Heat treatment of non-heat-treatable alloys after hot or cold rolling typically includes "annealing" at a temperature above the recrystallization temperature to cause recrystallization and grain growth, and subsequent cooling. Temperatures for annealing typically range from about 260° C. to 450° C., for example. Whereas the cooling rate can have an influence on the resulting microstructure. Typically, non-heat-treatable alloys are naturally cooled at room temperature or with enforced fan cooling.

Heat Treatment Mechanisms will be discussed with reference to FIG. 3. A general requirement for precipitation strengthening of supersaturated solid solutions in heat-treatable alloys involves the formation of finely dispersed precipitates during aging heat treatments. Heat treatment for precipitation strengthening in heat-treatable alloys includes a "solution heat treatment" or SHT at a high temperature to maximize the concentration of hardening elements being in solid solution, followed by rapid cooling or quenching to a low temperature to obtain a solid solution supersaturated with both solute elements and vacancies. Solution heat treatments are designed to maximize the solubility of elements that participate in subsequent aging treatments. They are most effective near the solidus or eutectic temperature, where maximum solubility exits, and diffusion rates are rapid. A heat-treatable alloy annealed at higher temperatures in the solid solution region (closer to solidus) results in a higher strength after age hardening (so-called: "paint bake response") FIG. 4A. However, care must be taken to avoid incipient melting of low-temperature eutectics and grain-boundary phases. Such melting results in quench cracks and loss in ductility. The maximum temperature may also be set regarding grain growth, surface effects, and economy of operation. The minimum temperature should be above the solvus, otherwise the desired properties derived from aging may not be realized. The optimum temperature range for solution heat treatment may be quite small. Temperatures for solution heat treatment are generally higher than annealing temperatures and may range for different compositions typically from about 460° C. to 570° C., for example, depending on the alloy composition. The solid solution time of conventional alloys (e.g. 6016) ranges typically from 20-40 s. Longer annealing times allow higher strength after aging FIG. 4B.

For the best dissolution for of precipitations during solid solution, the heat treatment time and heat treatment temperature should be high FIG. 5. Sufficient time in combination with higher temperatures are needed to get full dissolution. If the temperature coarsening of precipitations might take place respectively precipitations are generated in extreme case. If the annealing time is short, even while applying higher temperatures, the precipitations might not be dissolved sufficiently. The proposed process enables high temperature and longer times. Longer annealing times ($T_L$) will reduce the number of residual particles (precipitations) but might drive a coarsening of the particles FIG. 6. The appropriate combination of time and temperature is beneficial to generate the optimum microstructure during annealing.

Quenching is a crucial step of the sequence of heat-treating operations. The objective of quenching of heat-treatable alloys is to preserve the solid solution formed at the solution heat treating temperature, by rapidly cooling to some lower temperature, usually near room temperature. In general, dissolved solution formed during solution heat treatment should be quenched rapidly enough (and without interruption) to produce a supersaturated solution at room temperature, which is the optimal condition for precipitation hardening. Slow quenching, however, may improve other properties at specific alloys for particular use.

Conventional methods of manufacturing of aluminum alloy sheet for use in commercial applications employ batch processes which include a sequence of separate steps which is applied to an aluminum product in coil form. For non-heat treatable alloys, it is common that the coil is annealed in a batch step to obtain 0-temper. The term "0-temper" refers to a basic temper designation developed by the Aluminum Association. To produce heat-treated sheet products the coiled sheet is subjected to separate heat-treating operations, typically in a continuous heat-treating line. This typically involves unwinding the coil, solution heat treatment at a high temperature in a continuous process, quenching in a continuous process, and recoiling.

A conventional continuous heat treatment line requires high CapEx (typically >$50,000,000), requires lot of floor space, and requires the strip to be led through a long line paths, passing numerous deflection rolls which increase the risk of surface marks. The annealing time and quenching time are determined by the overall line speed and can't be separated in a conventional floating strip continuous heat treatment line. Consequently, annealing or quenching is compromised. Further conventional heat-treating lines are limited at high gauges above 6.5 mm as the strip is feed through multiple deflector rolls. As the line runs a continuous strip (pull) the tension control is very critical and limits the applied temperature profile.

To heat treat sheets of higher gauges>6.5 mm a so called "plate flow path" is applied. The plate heat treatment is a "piece by piece" process with an unfavorable cost structure compared to continuous strip processes. The typical gauges in plate production are 10-300 mm. The intermediate range of 6.6 to 15 mm is very costly in a plate flow path and very difficult to realize in conventional strip processing.

As continuous annealing lines (CASH lines) have a min CapEx threshold they are most competitive targeting maximum output (about 100.000 t/a). This conflicts with local market opportunities regarding accessible demands at customers. U.S. Pat. No. 7,182,825 B2 or U.S. Pat. No. 5,356,495 describe examples of continuous in-line methods of making aluminum alloy sheet.

SUMMARY

These and other needs are addressed by the various embodiments and configurations of the present disclosure. The proposed batch quenching process can fill the gap between conventional strip processes and plate processes in regard to gauge (thickness of the sheet).

In some embodiments, a method of manufacturing aluminum alloy sheet includes the steps of:

(a) heating, in a heat-treatment furnace and at an elevated first temperature, a coil of aluminum alloy sheet to form a heat-treated coil;

(b) while at least a portion of the heat-treated coil remains in the heat-treatment furnace:

(i) uncoiling a heat-treated portion of the aluminum alloy sheet from the heat-treated coil;

(ii) passing the uncoiled heat-treated portion of the aluminum alloy sheet through an outlet of the heat-treatment furnace; and (iii) continuously quenching, by a quenching unit, the uncoiled heat-treated portion to form a quenched sheet.

In some embodiments, a method includes the steps of:

(a) solution heat treating, at an elevated first temperature, a coil of aluminum alloy sheet to form a heat-treated coil;

(b) while at least a portion of the heat-treated coil is being solution heat treated:

(i) uncoiling a heat-treated portion of the aluminum alloy sheet from the heat-treated coil; and (ii) continuously quenching the uncoiled heat-treated portion to form a quenched sheet.

The first temperature and time can be selected so that the aluminum alloy approximates a first desired (equilibrium) metallurgical state.

The heat-treated portion can be heat-treated portions successively uncoiled from the heated coil. The heat-treated coil can be uncoiled by a temperature-sensitive-drive located outside the heat-treatment furnace. To facilitate uncoiling, the heat-treated coil can define a coil axis, and the heat-treated coil can be maintained in the heat-treatment furnace with the coil axis being substantially horizontal.

The uncoiled heat-treated portion, when quenched, can have a temperature sufficiently below the solidus temperature (about 20° C.) and further comprising:

(c) pre-heating the coil in a second furnace in a second temperature range prior to inserting the coil into the heat-treatment furnace; and (d) while the pre-heat-treated coil is fully coiled, transferring the pre-heat-treated coil from the second furnace to the first furnace.

The pre-heat-treated coil can be transferred from the second furnace to the heat-treatment furnace in a transfer direction essentially parallel to the coil axis, and the coil can be transferred from the second furnace to the heat-treatment furnace via a long guide rod extending from second furnace to heat-treatment furnace.

The pre-heat-treated coil can be transferred from the second furnace along an axis perpendicular to the horizontal coil axis to the heat-treatment furnace by a transport mechanism. A high temperature stable lubricant can be applied before the coil enters the second furnace, and the heat-treatment and second furnaces can each comprise an inert gas atmosphere.

The heat-treated portion can be guided from a perimeter of an uncoiled portion of the heat-treated coil in an uncoiling direction tangential to a coil perimeter through the outlet of the batch annealing furnace, and the uncoiling direction can be a vertical direction and the outlet is on a bottom side of the first furnace.

The heat-treatment furnace can include a guide system to feed the heat-treated portion of the heat-treated coil into the quenching unit. The coil can be moved during uncoiling of the coil such that a vertical portion of the sheet article running tangential to the perimeter of the coil is maintained in the tangential direction at an outlet port of the heat-treatment furnace, and the quenching unit can be located outside of the heat-treatment furnace and below the outlet port.

The method can further include the step of maintaining an orientation of one or both of the outlet port and quenching unit substantially constant relative to an uncoiling position of the heat-treated portion when uncoiled from the heat-treated coil.

A deflecting unit can deflect the quenched sheet from a vertical orientation to provide a substantially horizontal orientation after the heat-treated portion is partly or fully quenched and substantially insensitive to surface defects.

The method can further include the step of subjecting the quenched sheet to an additional heat treatment after quenching. The heat-treated portion of the quenched sheet can be subject to stretching at an elevated temperature ranging from about 75 to about 250° C., and the elevated first temperature can be at least about 5° C. lower than a solidus temperature of the aluminum alloy.

An exposure time on targeted temperature of the coil in the heat-treatment furnace can be at least about 10 minutes and a residence time of the heat-treated portion in quenching or the quenching unit can be no more than about 30 seconds.

The quenched aluminum alloy sheet can advantageously include an ultra-fine and substantially uniformly distributed microstructure with one or more precipitating phases, and at least one of the phases can be processed below about 10 microns.

In some embodiments, a system includes:

(a) a heat-treatment furnace comprising a housing enclosing a volume dimensioned to receive a coil formed from an aluminum alloy sheet, the housing comprising an inlet port dimensioned to receive the coil into the furnace room and an outlet port, separate from the inlet port, for outputting a heat-treated portion of the aluminum alloy sheet uncoiled from the heat-treated coil, the inlet port having a larger opening size than the outlet port; and (b) a quenching unit comprising one or more quenching devices and sheet inlet and outlet ports to receive the heat-treated portion and output a quenched sheet, respectively, wherein the sheet inlet port of the quenching unit is spatially proximal to the outlet port of the heat-treatment furnace and wherein the one or more quenching devices are positioned within the quenching unit to quench the heat-treated portion to form the quenched sheet.

The heat-treated portion can include multiple heat-treated portions successively uncoiled from the heated coil.

The quenching unit can continuously quench the heat-treated portion of the uncoiled sheet passing through the quenching unit.

A rotatable coil support can support the heat-treated coil in the heat-treatment furnace. The coil support rotates the heat-treated coil about a horizontally-oriented coil axis while the heat-treated portion is successively uncoiled from the heat-treated coil. A coil rotation drive rotates the heat-treated coil about the coil axis while the heat-treated coil is in the heat-treatment furnace.

The heat-treatment furnace can solution heat treat the aluminum alloy sheet when coiled on the coil. A maximum temperature during solution heat treatment is typically at least about 5° C. lower than a solidus temperature of the aluminum alloy sheet, and the heat-treated portion can be free of contact with deflection and guiding rolls between the outlet port of the heat-treatment furnace and the sheet inlet port of the quenching unit.

The outlet port can be on a bottom side of the batch annealing furnace, and the sheet inlet port of the quenching unit can be positioned below the heat-treatment furnace. The quenching unit can be positioned between the outlet port and a deflecting unit can be located downstream of the quenching unit.

The quenching unit can apply a quenching agent to the heat-treated portion of the aluminum alloy sheet immediately downstream of the outlet port, and the one or more quenching devices can include at least one of a spray nozzle and a quench tank.

A guiding system can be positioned in the quenching unit to direct the heat-treated portion through the one or more quenching devices.

One or more of the following can be true: (a) a cooling agent applied in the quenching unit is in form of a gas and/or liquid; (b) the cooling agent applied in the quenching unit comprises a hot rolling emulsion; (c) the cooling agent applied in the quenching unit is preheated to ensure a more consistent heat transfer across a width and length of the heat-treated portion; (d) the cooling agent applied in the quenching unit is preconditioned before being fed into a spray nozzle of one or more quenching devices; (e) a blow off unit is positioned after the quenching unit to reduce an amount of quenching agent remaining on the heat-treated portion after quenching; (f) a guiding roll is positioned downstream of the quenching unit; and (g) a dressing roll is positioned downstream of the quenching unit.

A deflecting unit can be provided to deflect the heat-treated portion from a substantially vertical orientation to a substantially horizontal orientation. The heat-treated portion can be deflected when already quenched, fully (RT) or partially (intermediate temperature) and when the heat-treated portion is relatively insensitive to surface defects.

A dressing roll can be positioned downstream of the deflecting unit. The dressing roll can perform a skin pass after quenching. The skin pass can include a first skin pass that improves a degree of flatness of the heat-treated and a second skin pass can be applied by embossed skin pass working rolls downstream of the dressing roll.

A stretch levelling unit can be provided downstream of the deflecting unit, and the deflecting unit can include one or more deflecting rolls.

The system can include at least a second furnace to perform a final annealing or heat treatment, the second furnace can be positioned between the heat-treatment furnace and the quenching unit, and the heat heat-treated portion can be heated when coiled on the coil in both the heat-treatment and second furnaces.

A brush positioned downstream of the quenching unit can remove any residuals and surface defects from the quenched sheet.

In some embodiments of the disclosure, a method of manufacturing aluminum alloy sheet can include the steps of:

(a) providing a sheet article at a predetermined gauge capable of forming a coil, the sheet article made of an aluminum having a major content of aluminum and a minor content of one or more additional elements;

(b) forming a coil from the sheet article; (c) inserting the coil into a first furnace;

(d) heat treating the coil in the first furnace at elevated heat-treating temperatures in a first temperature range so that the aluminum alloy approximates a first desired (equilibrium) metallurgical state;

(e) uncoiling successive portions of the sheet article from the heated coil while a remaining portion of the heated coil remains in the first furnace;

(f) guiding portions of the sheet article uncoiled from the coil out of the first furnace; (g) continuously quenching the portions of the sheet article uncoiled from the coil after guiding the portions out of the first furnace.

The aluminum alloy can be a heat-treatable aluminum alloy but not limited to heat treatable alloys.

The method can include the further steps of:

(h) pre-heating the coil in a second furnace in a second temperature range prior to inserting the coil into the first furnace; and transferring of the coil from the second furnace to the first furnace.

The coil can define a coil axis and the coil can be held in the first furnace with a horizontal coil axis.

The coil can be transferred in a transfer direction essentially parallel to the coil axis when transferred from the second furnace to the first furnace.

The coil can be moved transversely along an elongated guide rod extending from second to first furnace.

Successive portions of the sheet article can be guided from a perimeter of the remaining portion of the heated coil in an uncoiling direction tangential to the perimeter through an outlet port of the batch annealing furnace.

The uncoiling direction can be in a vertical direction and the outlet port can be on a bottom side of the first furnace. This configuration can enable gravity assisted surface treatment of the sheet or strip as it exits the furnace.

At least one of the coils and the outlet port can be moved during uncoiling of the coil such that a vertical portion of the sheet article running tangential to the perimeter of the coil is always running through the outlet port.

Quenching can be performed by applying quenching medium to successive portions of the sheet article immediately downstream of the outlet port.

A deflecting unit can deflect sheet from a vertical orientation to a horizontal orientation with the quenching unit being located between the outlet port and the deflecting unit such that the sheet is deflected when already partially or fully quenched and insensitive to surface defects.

Successive portions of the quenched sheet article can be subject to an additional heat treatment after quenching, such as stabilizing or aging.

A maximum temperature during solution heat treatment in the first temperature range can be at least about 20° C. lower than a solidus temperature of the aluminum alloy such that overheating can be avoided and the heated sheet article can be mechanically more stable and less sensitive on the surface).

The method can provide novel combinations of (long) annealing time and (fast) quenching rates. Those combinations are favorable particularly in 2xxx and 7xxx alloys, but also in 6xxx alloys at higher gauges. In particular, it can be an enabler for alloys containing small additions (<0.5%) OF Zr, Sn, Ag or Sc respectively and other alloy additions including elements particular from the group rear earth or transition metals promoting extremely fine precipitation with slow kinetics (long annealing times).

The method can provide more efficient intermediate annealing at higher gauges, wherein prior to coiling the sheet article is rolled to a gauge between 6 mm and 12 mm (15 mm).

The sheet article can be thicker than usual, because heat treatment time is not critical. Gauges are commonly heat treated in a thin plate format that are too thick for heating in a continuous line.

A high temperature stable lubricant can be applied before the coil goes in furnace. The lubricant, for example, can be silicon or carbon base, similar formula as used in hot forming of Al sheet (QPF, SPF).

In the quenching unit, the cooling agent applied can be hot rolling emulsion, particularly in combination with hot skin pass.

A skin pass can be used after quenching. First, the skin pass improves the strip flatness as distortion results from quenching and prior cold rolling. Second, a stochastic surface structure is applied by embossed skin pass working rolls. The strip might be quenched to RT, but preferably to an elevated temperature (75-250° C.) to improve pattern replication from working roll to Al-sheet surface. The elevated temperature skin pass allows metallurgical treatments regarding IP nucleation and stress relaxation.

A strip feeding system can feed aluminum alloy strip through a furnace exit port, through a quenching system, through a brushing unit, through dressing rolls (skin pass(es)), a leveling unit, and a stabilization heat treatment furnace (before coiling). Once the first coil is heat-treated in the first furnace and a second coil is set into the first furnace arriving from the second furnace, the strips of the first and second coil might be mechanically joined by an appropriate mechanical joint and clamping system. The first strip will pull the second strip through the entire heat/quench/processing system to the re-coiler. This might happen to all successive coils to enable a quasi-continuous process.

Optionally, a protective gas atmosphere can be used in one or more of the furnaces.

According to another embodiment, the disclosure provides a system that includes:

(a) a first furnace comprising a housing enclosing a furnace room dimensioned to receive a coil formed from the sheet article, the housing comprising an input port dimensioned to receive the coil into the furnace room and an output port (separate from the input port) for outputting successive portions of the sheet article uncoiled from the coil;

(b) a quenching unit arranged downstream of the output port in a transportation direction of successive portions of the sheet article uncoiled from the coil, the quenching unit configured to continuously quench successive portions of the sheet article guided through the quenching unit. (output port size adapted to sheet cross section, e.g. 50 mm*2300 mm (max width in automotive sector, ggf 3000 mm); and (c) a rotatable coil support in the first furnace so that the coil may rotate about coil axis while successive portions of the sheet article are uncoiled from the coil.

A coil rotation drive can actively rotate the coil about a coil axis while in the first furnace.

The coil can uncoil automatically, whereas in the prior art a drawing force on annealed sheet is required.

The coil axis can be oriented horizontally

The outlet port can be on a bottom side of the batch annealing furnace. The quenching unit can be arranged below the first furnace.

A deflecting unit can deflect sheet from a vertical orientation to a horizontal orientation. The quenching unit can be arranged between the outlet port and the deflecting unit, such that the sheet is deflected when already quenched and insensitive.

Quenching can be performed by applying agent (e.g., fluid, moist, steam) to successive portions of the sheet article immediately downstream of the outlet port.

There can be no intermediate processing or treating step.

The deflecting unit can deflect the sheet from a vertical orientation to a horizontal orientation quenching unit between outlet port and deflecting unit.

The sheet can be deflected when already quenched and insensitive.

A maximum temperature during solution heat treatment in the first temperature range can be at least 20° C. lower than a solidus temperature of the aluminum alloy such that overheating can be avoided and the heated sheet article can be mechanically more stable, less sensitive on the surface).

The first furnace comprises a furnace room dimensioned to receive only one coil at a time.

A dressing roll can be arranged after the quenching unit, thereby enabling the use of a small furnace.

Aluminum alloy sheet manufactured by the process and the system may exhibit beneficial properties not obtainable by conventional manufacturing methods and systems.

The present disclosure can provide several advantages depending on the configuration.

By way of example, the method and system of this disclosure can provide a method and a system of manufacturing aluminum alloy sheet having beneficial properties including properties which cannot be obtained by conventional methods and systems. They can provide a method and a system of manufacturing aluminum alloy sheet which allow for unusual heat treatment cycles increasing the T-t processing window in manufacturing. They can provide components of a method and a system of manufacturing aluminum alloy sheet which allow for a cost-efficient manufacturing process.

The advantages in regard to alloy benefiting from the proposed process are manifold:

- Conventional 2xxx, 7xxx, 6xxx alloys can hold longer on temperature (increased soaking time) with less residual precipitates from prior processing;
- Modified 2xxx, 7xxx, 6xxx alloys with higher alloying content respectively blended compositions (production scrap, end of life scrap) can be processed at customized annealing practice (time-temperature);
- Alloys with the potential of ultrafine precipitations in the sub-micron region needing long solid solution annealing times (slow kinetics); and
- Conventional non-heat treatable alloys reveal a more consistent distribution of properties across the width and length of the coil.

They can provide components of a method and a system of manufacturing aluminum alloy sheet which require less complicated and less expensive furnace systems than conventional systems.

These and other advantages will be apparent from the disclosure of the aspects, embodiments, and configurations contained herein.

As used herein, "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C", "A, B, and/or C", and "A, B, or C" means A alone, B alone, C alone, A and B together, A and C together, B and C together, or A, B and C together. When each one of A, B, and C in the above expressions refers to an element, such as X, Y, and Z, or class of elements, such as $X_1$-$X_n$, $Y_1$-$Y_m$, and $Z_1$-$Z_o$, the phrase is intended to refer to a single element selected from X, Y, and Z, a combination of elements selected from the same class (e.g., $X_1$ and $X_2$) as well as a combination of elements selected from two or more classes (e.g., $Y_1$ and $Z_o$).

It is to be noted that the term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

The term "means" as used herein shall be given its broadest possible interpretation in accordance with 35 U.S.C., Section 112(f) and/or Section 112, Paragraph 6. Accordingly, a claim incorporating the term "means" shall cover all structures, materials, or acts set forth herein, and all of the equivalents thereof. Further, the structures, materials or acts and the equivalents thereof shall include all those described in the summary of the disclosure, brief description of the drawings, detailed description, abstract, and claims themselves.

Unless otherwise noted, all component or composition levels are in reference to the active portion of that component or composition and are exclusive of impurities, for example, residual solvents or by-products, which may be present in commercially available sources of such components or compositions.

All percentages and ratios are calculated by total composition weight, unless indicated otherwise.

It should be understood that every maximum numerical limitation given throughout this disclosure is deemed to include each and every lower numerical limitation as an alternative, as if such lower numerical limitations were expressly written herein. Every minimum numerical limitation given throughout this disclosure is deemed to include each and every higher numerical limitation as an alternative, as if such higher numerical limitations were expressly written herein. Every numerical range given throughout this disclosure is deemed to include each and every narrower numerical range that falls within such broader numerical range, as if such narrower numerical ranges were all expressly written herein. By way of example, the phrase from about 2 to about 4 includes the whole number and/or integer ranges from about 2 to about 3, from about 3 to about 4 and each possible range based on real (e.g., irrational and/or rational) numbers, such as from about 2.1 to about 4.9, from about 2.1 to about 3.4, and so on.

The preceding is a simplified summary of the disclosure to provide an understanding of some aspects of the disclosure. This summary is neither an extensive nor exhaustive overview of the disclosure and its various embodiments. It is intended neither to identify key or critical elements of the disclosure nor to delineate the scope of the disclosure but to present selected concepts of the disclosure in a simplified form as an introduction to the more detailed description presented below. As will be appreciated, other embodiments of the disclosure are possible utilizing, alone or in combination, one or more of the features set forth above or described in detail below.

BRIEF DESCRIPTION OF THE DRAWINGS

The accompanying drawings are incorporated into and form a part of the specification to illustrate several examples of the embodiment(s) of the present disclosure. These drawings, together with the description, explain the principles of the embodiment(s) of the present disclosure. The drawings simply illustrate preferred and alternative examples of how the embodiment(s) can be made and used and are not to be construed as limiting the disclosure to only the illustrated and described examples. Further features and advantages will become apparent from the following, more detailed, description of the various embodiments of the disclosure, as illustrated by the drawings referenced below.

FIGS. 1C/1D show the furnace arrangement with additional strip treatments.

DETAILED DESCRIPTION

Several preferred embodiments of systems and methods utilizing the concepts of the present disclosure are now described in detail in connection with exemplary schematic figures. In general, the method and system have been designed to provide flexibility to run unique heat treatment cycles in the manufacturing of aluminum alloy sheet products derived from a sheet article preprocessed by appropriate process steps to form a strip of aluminum alloy having a predetermined gauge capable of forming a coil. The strip of aluminum alloy which forms the coil can be prepared by any number of processing steps including continuous casting techniques well known to those skilled in the art.

Figure 1A:
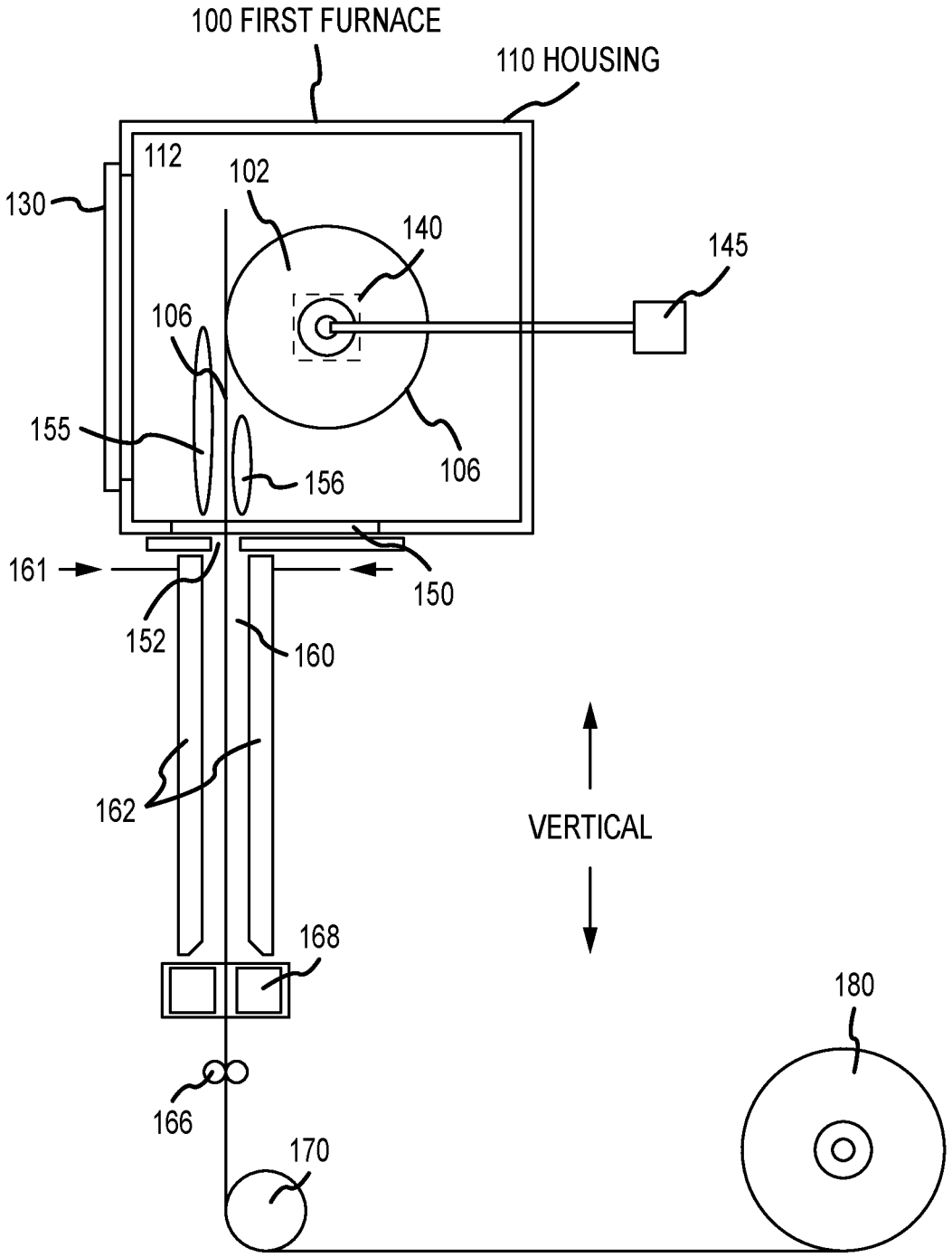
FIGS. 1A-1D are side views of a process according to an embodiment of the present disclosure.
Figure 1B:
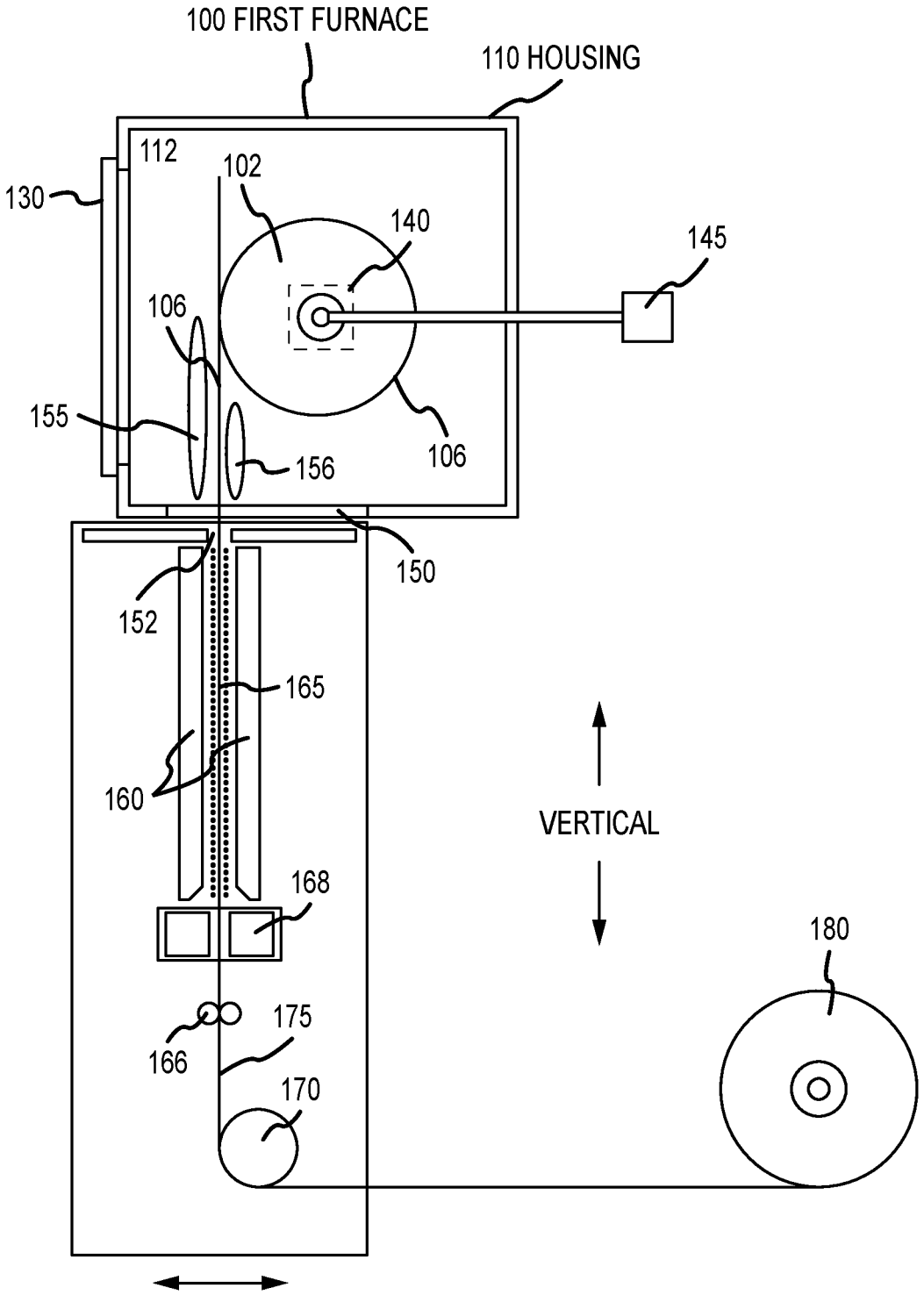
Figure 1C:
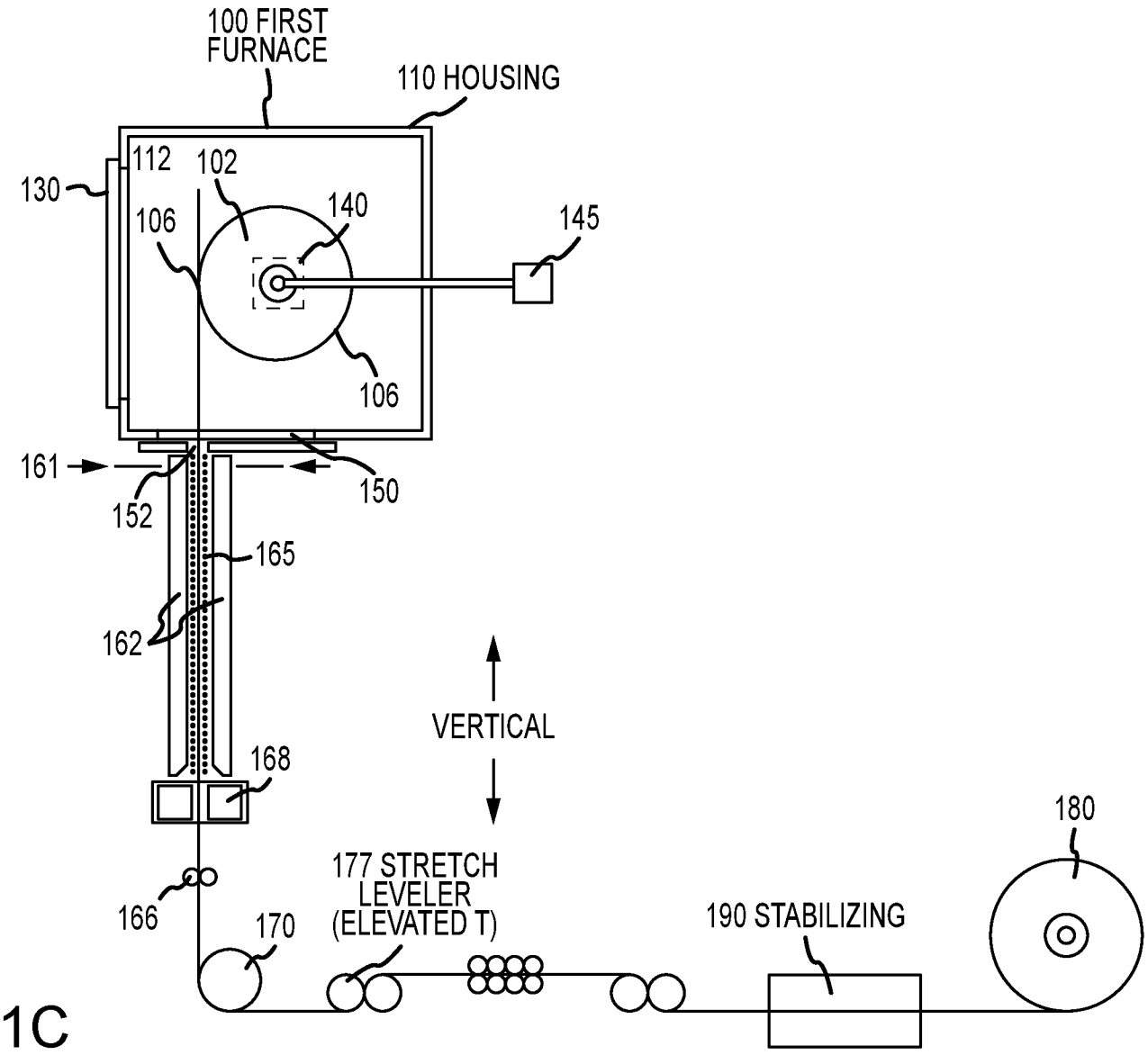
Figure 1D:
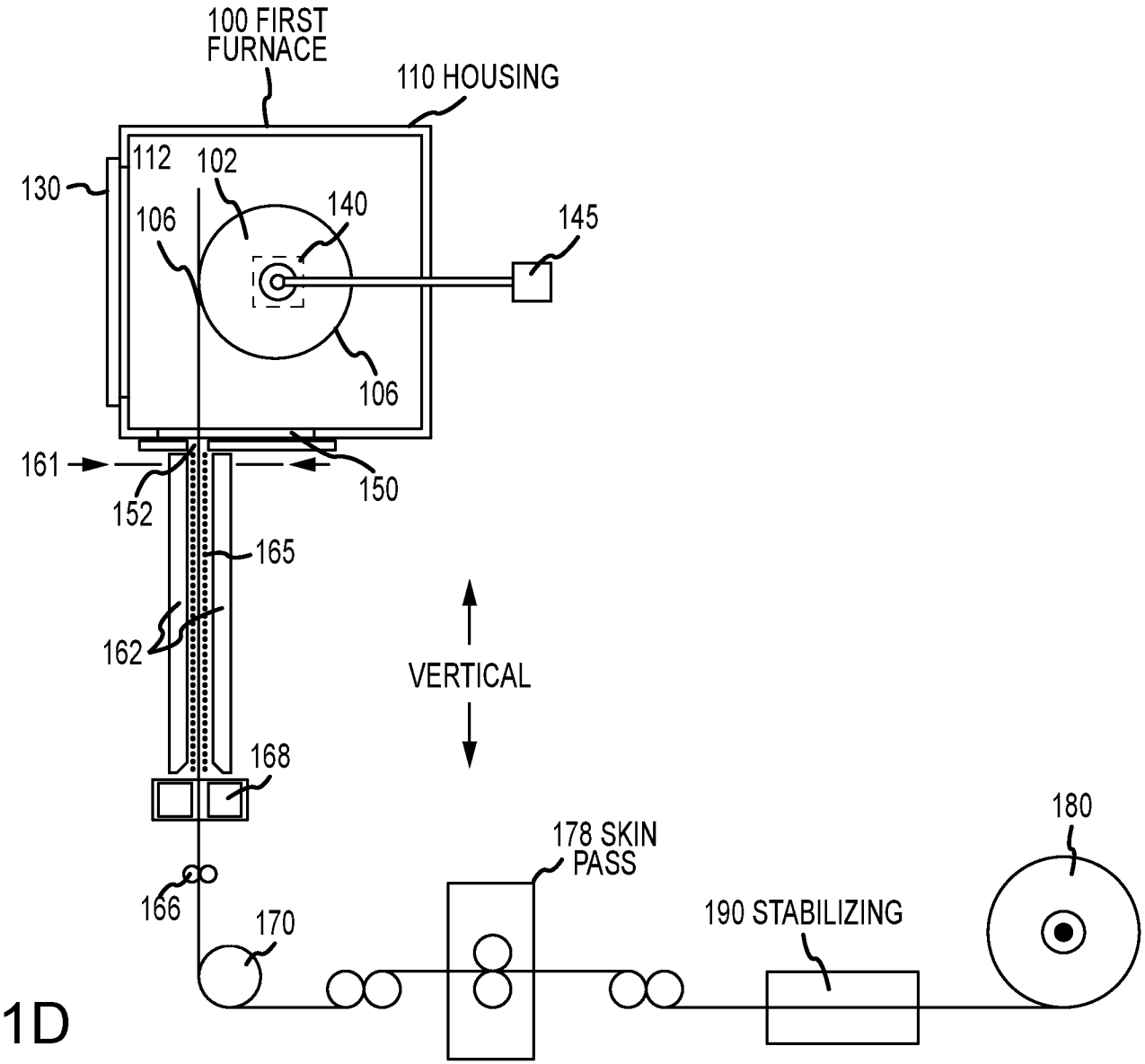
Figure 2A:
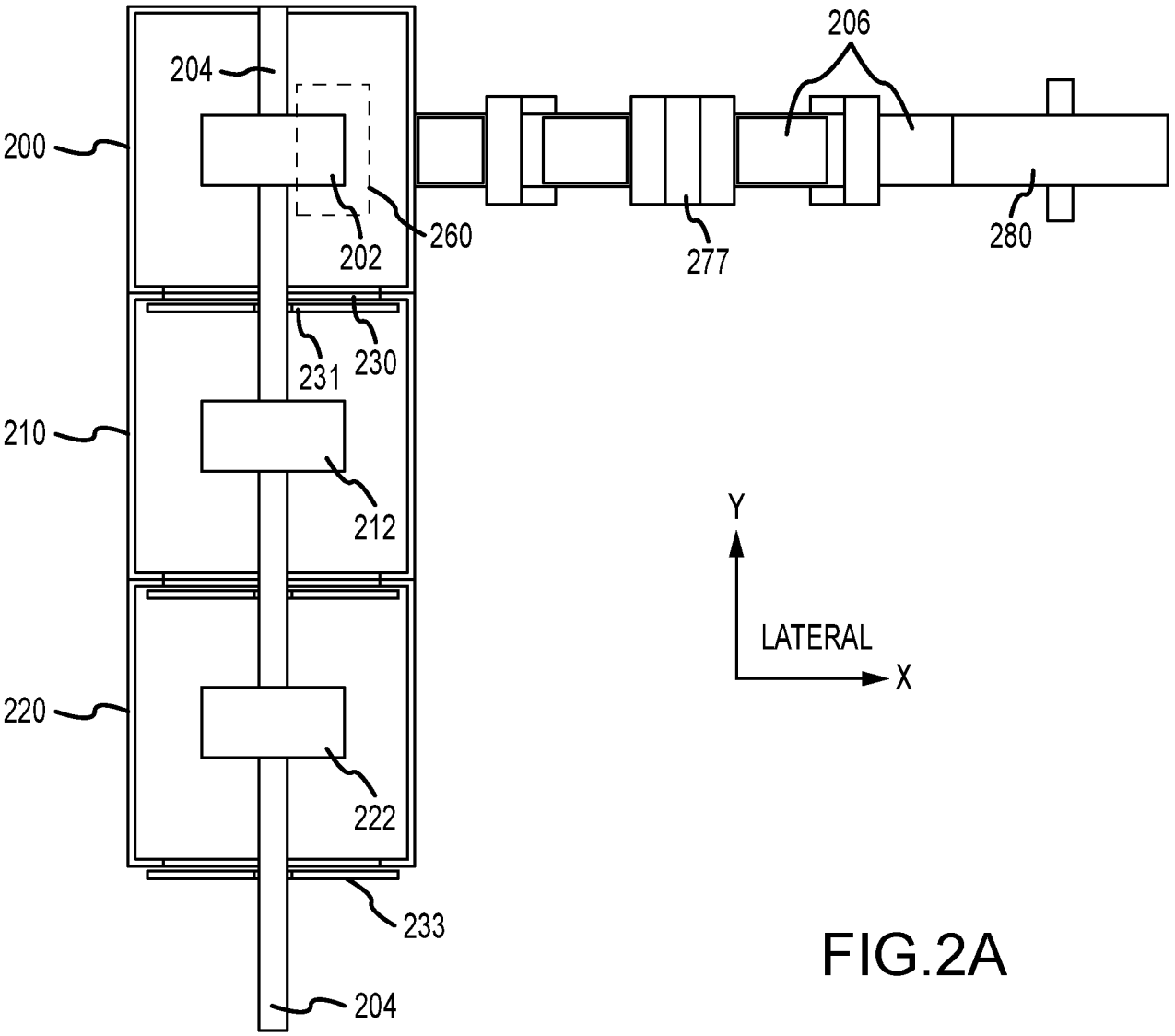
FIG. 2A-2B depicts top view of an array from, first, and successive furnaces according to an embodiment of the present disclosure.
Figure 2B:
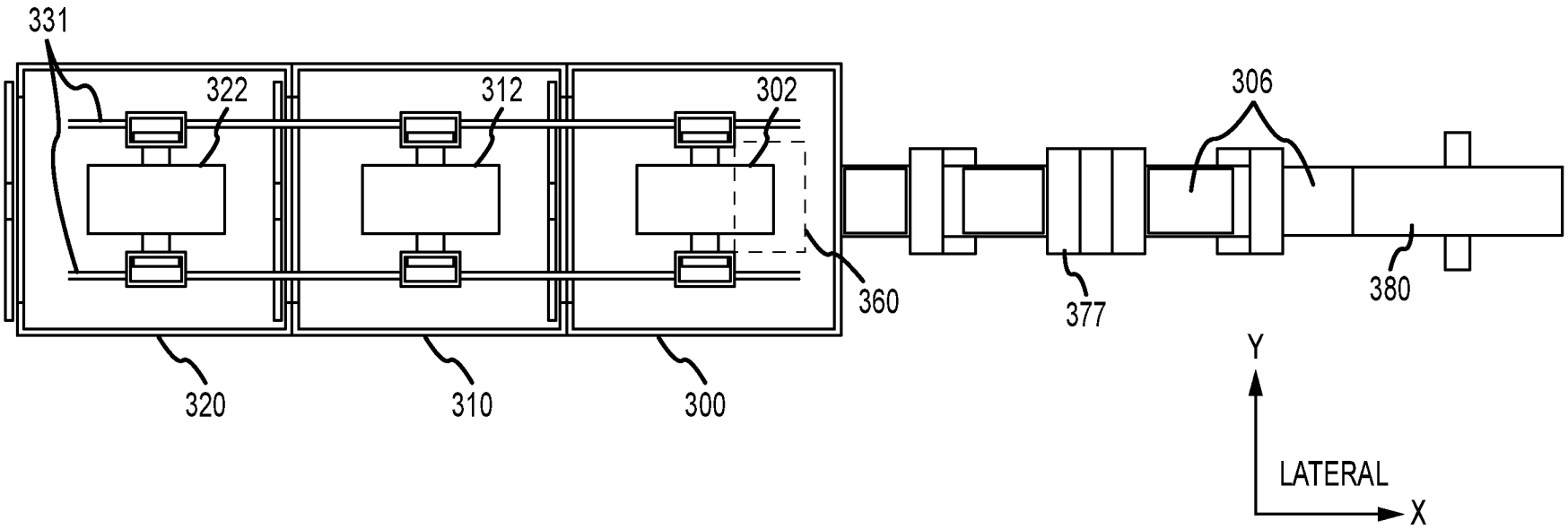
Figure 3:
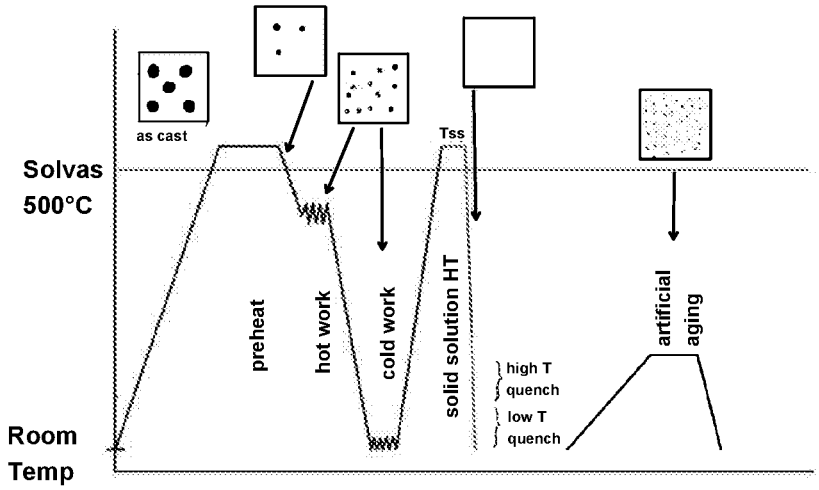
FIG. 3 is a plot of temperature (vertical axis) versus time (horizontal axis) to illustrate thermal history of an aluminum alloy according to an embodiment of the present disclosure.

As discussed further below:

FIG. 1A depicts a First Furnace and quenching unit (Coil manipulated in furnace 1 to keep the strip vertically in constant position);

FIG. 1B depicts a First Furnace and quenching unit (Quench unit manipulated to follow the actual strip position);

FIG. 1C depicts a First Furnace option with successive strip treatments (Stretch levelling & Stabilizing);

FIG. 1D depicts a First Furnace option with successive strip treatments (Skin pass to introduce surface topography on the strip);

FIG. 2A depicts an Array from second furnaces for improved efficiency and high-volume requirements & allowing multi-step annealing circles (i.e. cycles) (coil feed in direction of coil eye);

FIG. 2B depicts an Array from second furnaces for improved efficiency and high-volume requirements & allowing multi-step annealing circles (i.e. cycles) (coil feed perpendicular to coil eye);

FIG. 3 depicts the temperature history for processing heat treatable alloys

Figure 4A:
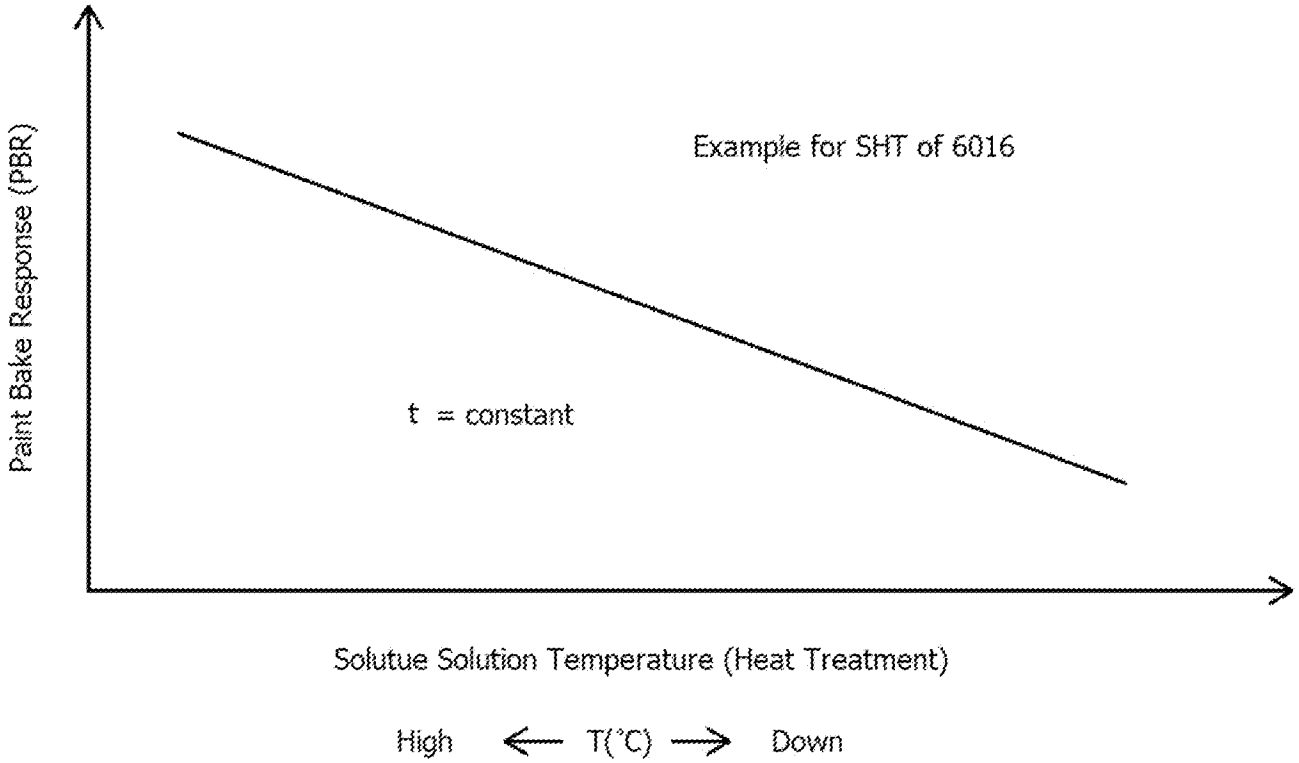
FIG. 4A-4B is a plot of paint bake response (vertical axis) versus temperature (horizontal axis, A) respectively versus time (horizontal axis, B) to illustrate thermal history of an aluminum alloy according to an embodiment of the present disclosure; Higher solid solution T and annealing times are favorable for higher strength, specifically in regards to paint bake response.
Figure 5:
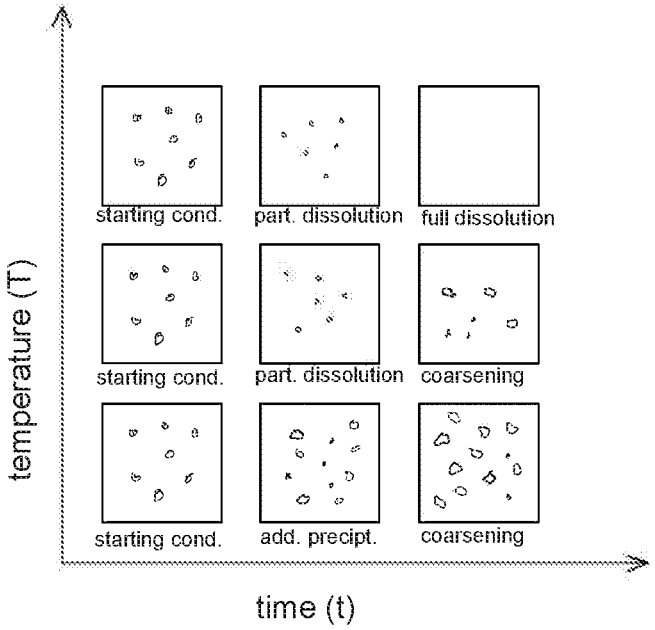
FIG. 5 is a plot of temperature (vertical axis) versus time (horizontal axis) to show the aluminum alloy coarsening and dissolution process according to an embodiment of the present disclosure.
Figure 6:
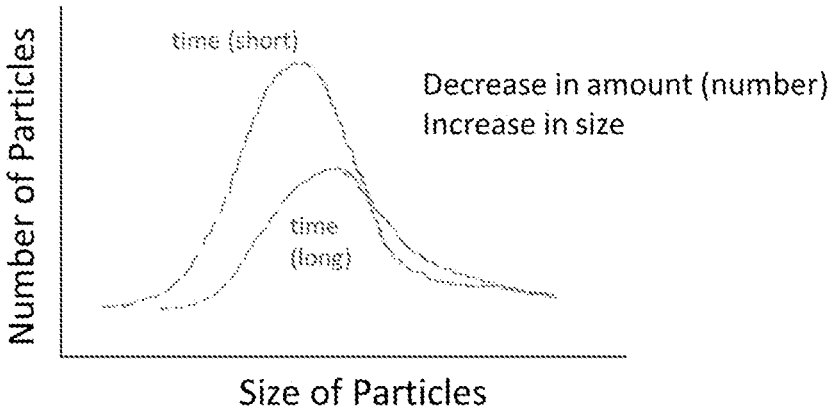
FIG. 6 is a plot of number of particles (vertical axis) versus size of particles (horizontal axis) according to an embodiment of the present disclosure for shorter times and longer times in exposed to heat treatment.
Figure 7:
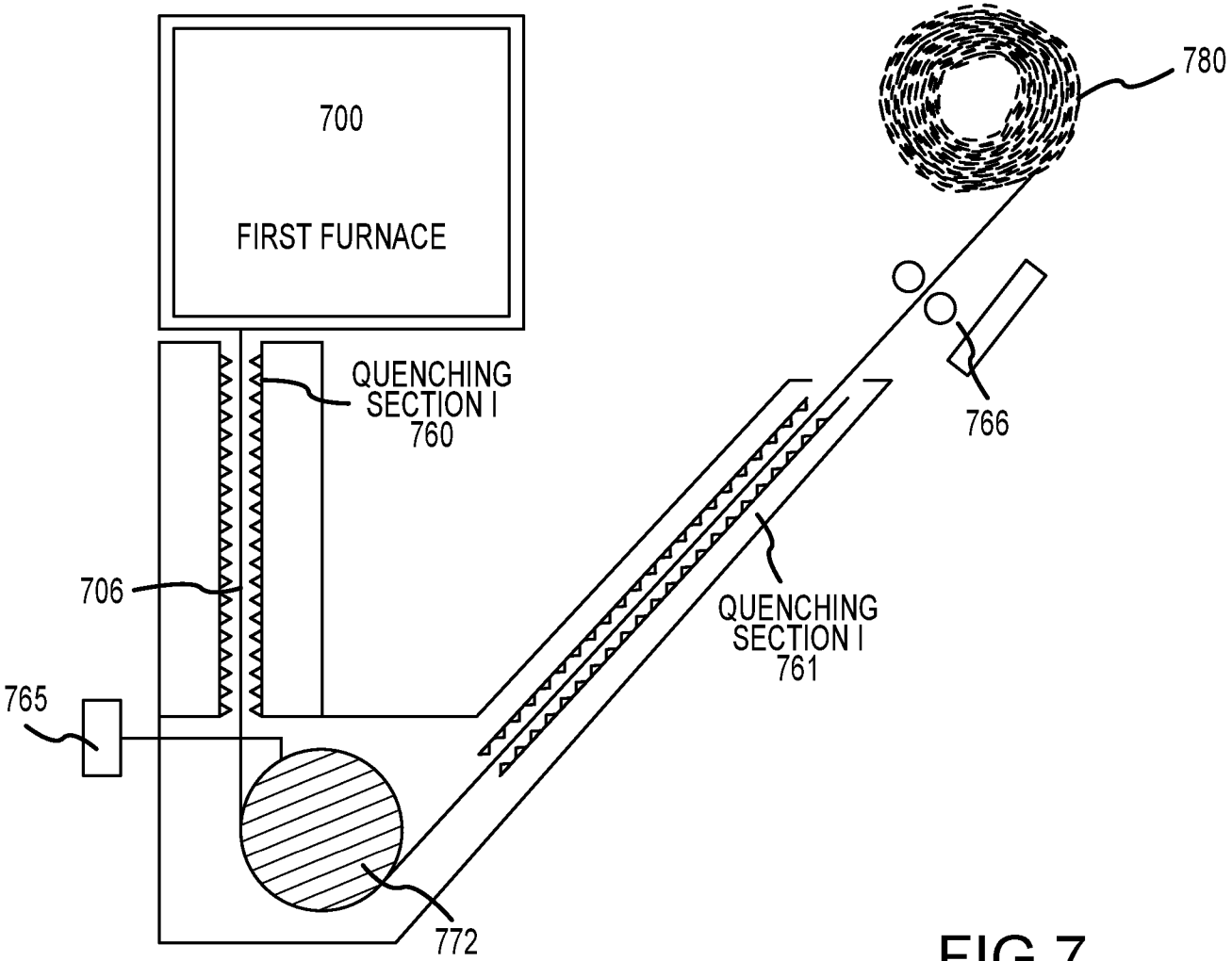
FIG. 7 shows a side view of the process where the quenching is separated into two successive quenching units.
Figure 8A:
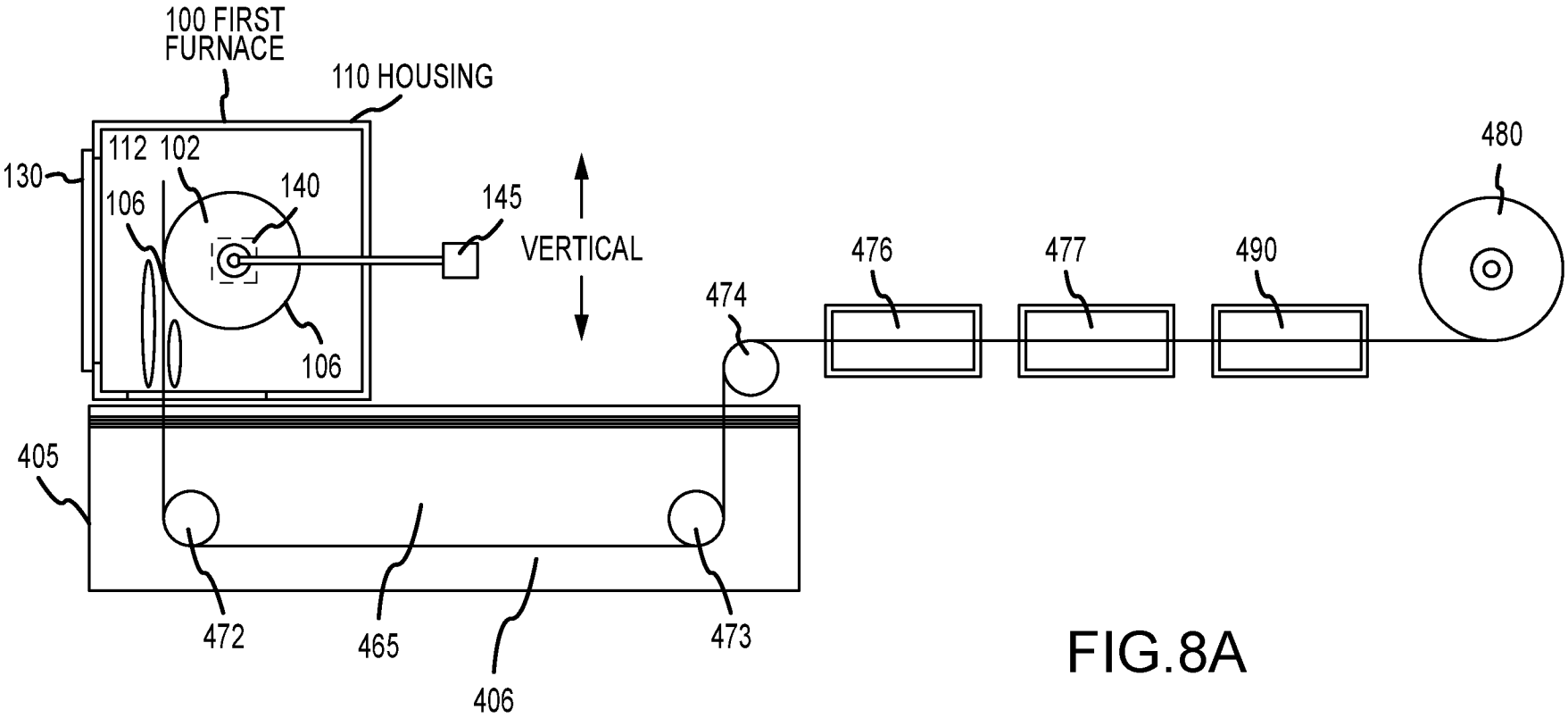
FIG. 8A-8B shows a side view of the process where the quenching unit is in a basin configuration with liquid quenching media.
Figure 8B:
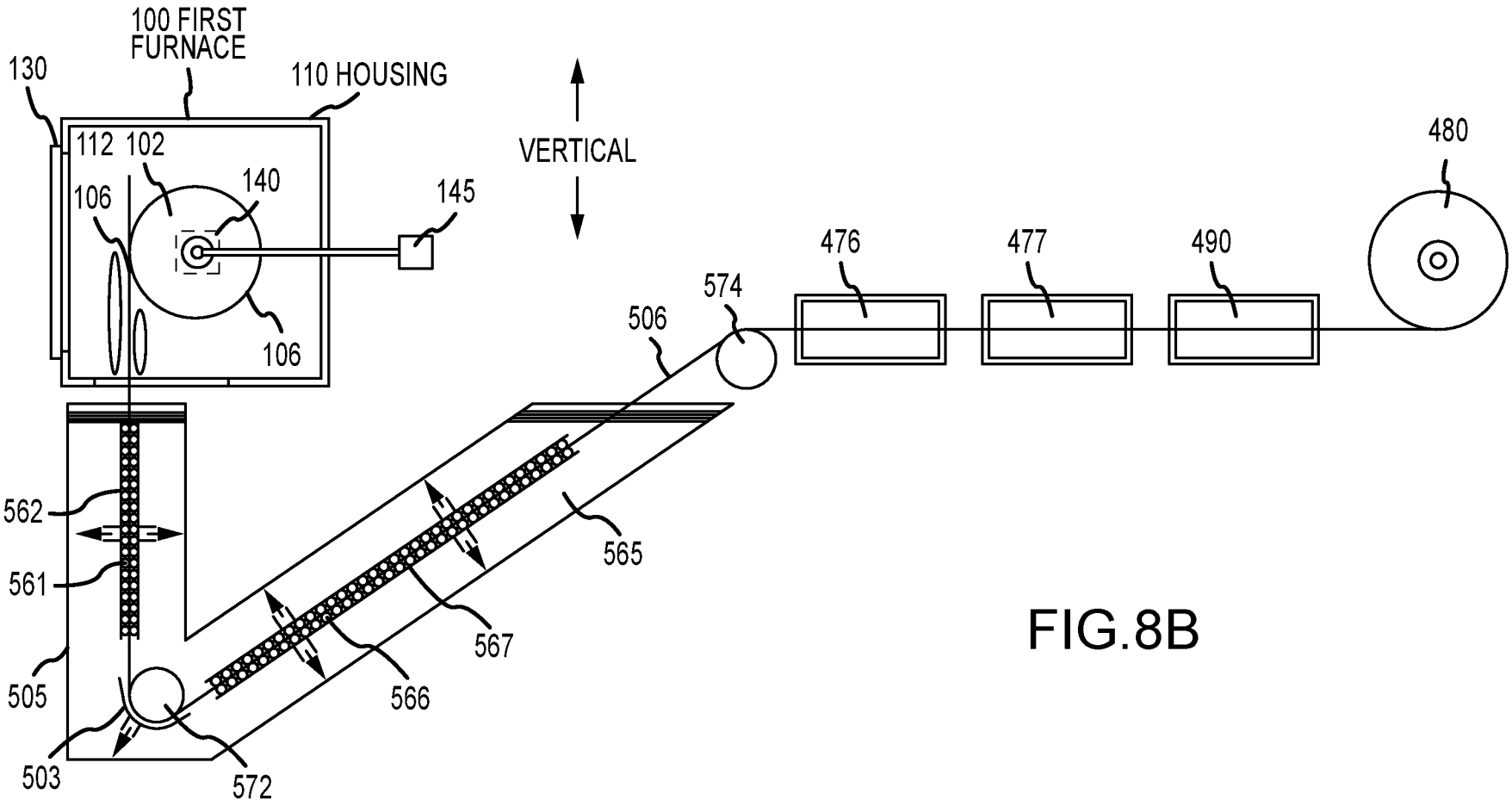

FIGS. 4A (left) and 4B (right) depicts the need to apply higher temperature and longer times during annealing treatment to gain maximum paint bake response in aging process (compare with FIG. 1);

FIG. 5 depicts the coarsening and dissolution process with time and temperature. Sufficient time in combination with higher temperatures are needed to get full dissolution. The proposed process enables high temperature and longer times;

FIG. 6 depicts a coarsening of particles during heat treatment. Some longer time annealing can reduce the area fraction of particles but is leading to coarsening. The proposed process enables to apply appropriate temperature/time combinations;

FIG. 7 depicts a cooling unit in which the strip is fed thru two distinct cooling units;

FIG. 8A depicts a cooling unit in which the strip is fed thru a basin containing cooling agent (horizontal version);

FIG. 8B depicts a cooling unit in which the strip is fed thru a basin containing cooling agent (V-shape version).

Decoupling Annealing Procedure from Quenching Process

The method and system can provide a novel combination of features characteristic of batch-type annealing/heat treatment and features characteristic of continuous quenching. In principle, heat treatment of the coil in the first furnace may be performed for any period of heat-treating time ("soak time") required to reach the desired first equilibrium state (few minutes to hours). Specifically, heat treating times may be sufficiently longer than heat treating times usually obtainable (typically about 20-90 seconds) in a continuous annealing line including annealing and quenching. The table below shows heat treatment times in continuous annealing lines for aluminum alloy sheets heat treated for automotive applications.

| | Automotive applications categorized regarding soaking time/temp (line efficiency) Flow Path (alloy, temper, gauge) | | | |
|---|---|---|---|---|
| | Product | | Gauge Range | |
| | Alloy | Temper | 1.0 to 3.5 mm | 3.5 to 6.5 mm |
| Heat Treatable Alloys | 6016 | T4x | 15 s-30 s/500-570° C. (typical 20 s) | 30 s-150 s/500-570° C. (typical 60 s) |
| | 6009/6111 | T4x | 15 s-30 s/490-560° C. (typical 25 s) | 30 s-150 s/480-550° C. (typical 60 s) |
| | 7075 | T4x | 50 s-200 s/450-530° C. (typical 120 s) | 100 s-300 s/450-530° C. (typical 200 s) |
| | 2xxx/7xxx | T4x | 50 s-220 s/440-520° C. (typical 130 s) | 50 s-320 s/440-520° C. (typical 220 s) |
| | Micro-fine precipitation | T4x | >300 s to hours/300-580° C. (not applied in cont. HT lines) | >300 s to hours/300-580° C. (not applied in cont. HT lines) |
| Non-HT Alloys | 5754 | H0 | 1-5 s/500° C. (typical s) | 1-10 s/500° C. (typical 1 s) |
| | 5182 | H0 | 1-5 s/500° C. (typical 1 s) | 1-10 s/500° C. (typical 1 s) |
| | 5182 | H2x | 1-5 s/500° C. (typical 1 s) | 1-10 s/500° C. (typical 1 s) |

On the other hand, quenching may be performed at virtually any practical quenching rate. The quenching rate can be set substantially independent of the heat-treating time in the first furnace. The method and process of this disclosure can obviate restrictions present in either conventional batch-type annealing and quenching processes and conventional continuous annealing and quenching processes.

For example, if long heat treatment times are required in a conventional continuous in-line operation the transport speed of the sheet strip transport will be reduced to low values to allow long throughput times in a furnace adapted for continuous annealing. Alternatively, or in addition, the effective lengths of the continuous annealing furnace may be increased to allow for the desired long throughput time. On the other hand, if a sheet strip is transported slowly to achieve long annealing/heat treatment times the transport speed through a quenching unit may be equally low, thereby limiting the quenching rate which can be achieved. Furthermore, subsequent chemical surface treatments or stabilization annealing is affected by change of line speed.

In contrast, in a method and system according to the present disclosure, heat treating times and quenching rates are de-coupled to a large extent so that the temperature-time (T-t) process windows for heat treatment may be dramatically increased relative to conventional processes so that aluminum alloy sheet products with novel properties may be obtained. Further, the method and system equally allow to run any conventional heat treatment process.

Furthermore, the applied temperature is less restricted because in the proposed system and method of this disclosure there is no need for controlling strip tension of a continuous moving strip (pull) like in the conventional way. The strip in the proposed technology is heat treated in coil form. In conventional continuous heat treatment slight local melting can result in catastrophic strip breakage with serious interruption of production. A breakup of an entire strip cannot happen in a coil form kind of heat treatment.

Compact Design

In terms of required investment, the novel combination of the first furnace and a quenching unit arranged downstream thereof may be built as a compact de-coiling-quenching station which requires less floor space than corresponding components in conventional continuous in-line production lines. CapEx is significant lower, and the system allows a flexible response to market demand and is capable to serve local markets (scalable). In the system and method of this disclosure, it is much easier to run high gauge strip above 6.5 mm which are limited in conventional continuous annealing lines. The risk of surface defects is reduced as the line is very short and the touchpoint with the feeding system minimized.

The strip-surface of the coil in furnace 1 is coated with a substance separating the coil windings from each other. This is advantageous as the strip-surfaces in contact of two windings can stick under certain temperature and pressure conditions. The substance might consist of a composition/structure revealing high temperature stability like graphite, graphene or a graphite free formula used in commercial aluminum hot-forming processes, preventing adjacent coil windings from "sticking" locally.

Sheet articles made from heat-treatable aluminum alloys may benefit significantly from the method and system. In that case, at least a final time interval of a solution heat treatment can be performed in the first furnace immediately before the solution heat treated material is continuously quenched. Heat-treatable aluminum alloys may particularly benefit from the new process and system because solution heat treatment may be performed, in principal, for an unlimited time before material is quenched.

However, also Non Heat-treatable Alloys (NHT) can benefit from the proposed batch-quenching process. The process can allow annealing within a precise T-t range (Temperature-time) with more constant properties across the coil width and length compared to conventional batch annealing.

Metallurgical Aspects

Figure 4B:
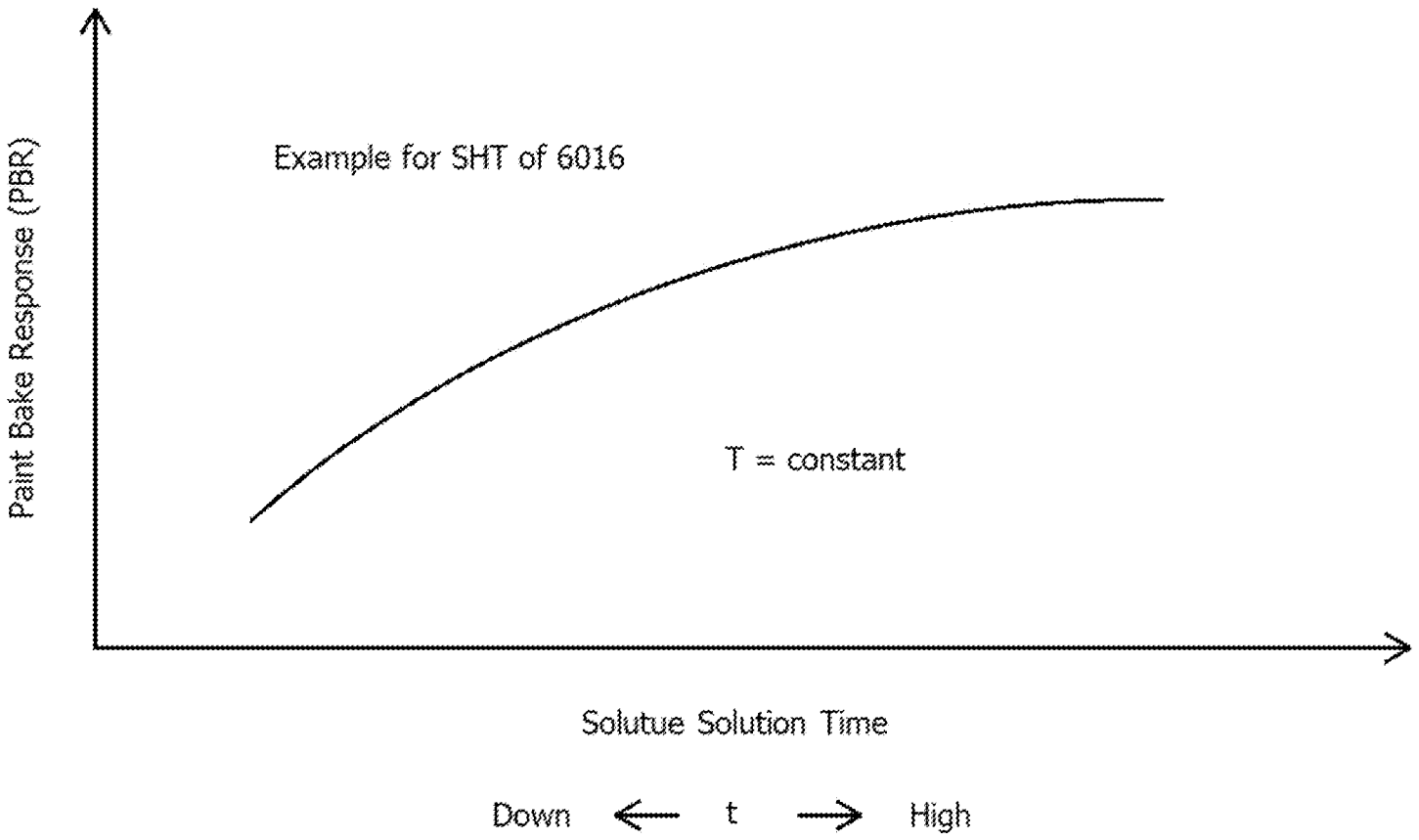

As is known, homogenization during solution heat treatment is a diffusion driven process. Increasing temperature increases diffusion rate of solute atoms exponentially. Increasing time at a given temperature increases solute diffusion rate only linearly. Therefore, solution heat treatment temperatures are usually selected as high as possible very close to the respective eutectic temperature while still avoiding partial melting. On the other hand, with "unlimited time" available for solution heat treatment, temperatures may be reduced into a "safer" temperature region. In some embodiments, a maximum temperature during solution heat treatment in the first temperature range is at least about 20° C. lower than a solidus temperature of the aluminum alloy. By doing so, overheating and partial melting can be safely avoided. Further, the heated sheet article can remain mechanically more stable and less sensitive on the surface than a sheet treated at higher temperatures closer to the solidus—as shown in FIGS. 2-4.

Alternatively, the aluminum alloy may be a non-heat-treatable aluminum alloy. In this case, heat treatment in the first furnace will typically be performed at annealing temperatures above the recrystallization temperature of the respective material, but significantly below temperatures usually used for solution heat treatment.

Array of Furnaces

In some embodiments of the method and system, the coil is pre-heated in a second furnace in a second temperature range prior to inserting the coil into the first furnace, and the coil is then transferred from the second furnace to the first furnace. A second furnace and a transfer unit to transfer the coil from the second surface to the first furnace may be provided for this purpose. Preferably, the heated coil is directly transferred from the second furnace to the first furnace without a significant intermediate drop in temperature, i.e. without intermediate cooling. A transfer lock thermally isolated from the surroundings may be provided for this purpose between the second furnace and the first furnace.

Temperatures of the second temperature range provided by the second furnace may be similar or identical to temperatures in the first temperature range provided by the first furnace so that the total soak time for the coil prior to quenching includes a partial soak time in the second furnace, the transfer time required for transfer between the second furnace and the first furnace, and a partial soak time spent in the first furnace immediately prior to quenching.

Providing one or more second furnaces in addition to a first furnace and appropriate transfer of the coil from the second furnace to the first furnace can allow for more efficient use of the capacity of a first furnace as part of a de-coiling quenching station.

Optionally the temperature in the second furnace might be lower than in the first furnace to allow a 2-step annealing cycle. The 2-step cycle can allow a changing of microstructure in case chemical inhomogeneities reveal locally lower liquidus temperatures (risk of local melting). The 2-step could also be applied in the first furnace if needed. The two-step circle (i.e. cycle) can allow higher solid solution temperatures resulting in higher strength level of the sheet article, in respect to "paint bake response" of automotive sheets. Further the second furnace (second temperature) can be used either for homogenization or heterogenization purpose(s) of the strip prior to going into the first furnace. By way of example, 1. 1-step heat-treatment: Solid solution temperature typically >20° C. below solidus in 2/7/6xxx alloys
2. 2-step heat-treatment: Higher solid solution temperatures are possible closer to solidus.
3. Multistep heat-treatment: like in 2-step circle (i.e. cycle) but further heterogenization can be applied, e.g. for more uniform recrystallisation Optionally or alternatively, multistage annealing in the first furnace as well as in the array of second furnaces can be performed by installing one or an array of "heaters" at the bottom exit of first furnace before feeding the strip into the quenching unit. The heaters can be any type of heater, such as gas heaters, with linear units for the left and right side of the strip being preferred. Optionally or alternatively, air or another gaseous media can be applied to heat the strip at the exit of the first furnace. The additional heating might be needed in case a peak strip temperature is desired for a limited time before quenching.

The heating method in furnace 1 (or the first furnace) can be by gas or electrical systems. The heat can be blown on the coil faces if a best possible temperature distribution across the coil is required. Alternatively, the heat is blown on the coil outer strip windings, the outer strip windings experience the required temperature whereas the inner coil region are heating up with a slower rate.

Optionally, a higher "flash" temperature T>coil temperature applied at the exit gauge of furnace 1 heating up the strip just de-coiled from the coil. This can allow lower temperatures of the uncoiled part of the coil in the first furnace. This might be advantageous in special cases of a heat treatment cycle. As an example, but not limited to this event are conditions to achieve high homogeneity while preventing secondary recrystallisation.

Coil Handling Design

The coil may be held in the first furnace in any suitable orientation of the coil axis, e.g. with vertical coil axis. Preferably, the coil is held in the first furnace with a horizontal coil axis. A horizontal coil axis enables easy loading and uncoiling.

Where a second furnace adjacent to the first furnaces is provided the coil is preferably transferred in a transfer direction essentially parallel to the coil axis when transferred from the second furnace to the first furnace. A long guide device, such as a rod, extending from the second furnace to the second furnace through a transfer lock may be provided for this purpose. Coils may be coiled onto a tube-like coil support slidable guided by the guide device.

In a final phase of the annealing/heat treatment performed in the first furnace, successive portions of the sheet article may be guided from a perimeter of the remaining portion of the heated coil in an uncoiling direction tangential to the perimeter through an outlet part of the batch annealing furnace. The uncoiling direction may be horizontal, for example, in a case where the outlet port is situated in a side wall of the first furnace.

In preferred embodiments, however, the uncoiling direction is a vertical direction and the outlet port is on a bottom side of the first furnace. The arrangement may be such that mainly gravitational forces act on the uncoiled successive portions so that the hot sensitive sheet strip may hang freely from the perimeter of the remaining hot coil.

Although it is possible to provide a drawing unit which actively draws successive portions of the sheet article from the perimeter of the remaining coil in the first furnace, it may be preferable to advance the uncoiling process exclusively or additionally by actively rotating the coil held in the first furnace in order to promote uncoiling. A rotational drive engaging the coil held in the first furnace may be provided for this purpose. The arrangement can allow the coil to be processed at lower strip tension when compared to conventional continuous annealing lines.

When successive portions of the sheet article are uncoiled from the remaining coil, the diameter of the remaining coil will continuously decrease. At least one of the coils and the outlet port may be moved substantially simultaneously with the decrease in coil diameter during uncoiling of the coil such that a vertical portion of the sheet strip running tangential to the perimeter of the coil is always running through the outlet part. A vertical uncoiling direction of the uncoiled sheet may thereby be maintained independent of the diameter of the remaining coil throughout the uncoiling time. Alternatively, the cooling and deflection unit might move in synchronization with the outlet part (perimeter of the coil in first furnace).

Quenching Arrangement

Quenching of successive portions uncoiled from the heated coil may be performed by any suitable quenching means. Quenching may be achieved by a quenching gas or spraying or feeding through water or an aqueous solution or a mixture of a quenching liquid as oil onto the hot sheet after exiting the first furnace. In the case of using oil or an oil emulsion, the oil is of that kind that it does not cause stains on the strip surface. Preferably, quenching is performed by applying a quenching fluid to successive portions of the sheet article immediately downstream of the outlet part after the successive portions have passed through the outlet port. In other words, there is preferably no intermediate processing or treating step provided between annealing/heat treatment and subsequent quenching.

The quenching is typically applied to room temperature with water/air spray, however a quenching at elevated temperature (e.g. at about 80-100° C. with water mist) can be applied to ensure homogeneous distributing of temperature across the strip and therefore consistent quenching rates at the metal. The quenching media might be conditioned before leaving a nozzle system which are directed onto the moving strip leaving the furnace preferred vertically. Precondition means the droplets of the cooling agent shows a narrow distribution in temperature and size. The vertical position also ensures even quenching condition of both sides of the aluminum strip.

For special metallurgical reasons (pre-aging, nucleation of intermetallic phases), the quenching agent might be pre-tempered at about 80-250° C. The preferred temperature set method for a defined elevated temperature quench is the temperature pre-set of the agent. However, other methods like hot air, induction or heat radiation can be applied after quenching.

With reference to FIG. 7, the generic outline of the heat treatment system is a vertical arrangement of the quenching unit downstream from the first furnace 700 that is separated in two heat-treatment sections, whereas the first segment 760 and the second segment 761 serve under specific conditions as the quenching process has two distinct objectives. The first objective is to keep solute alloying elements in solute solution in the heat treated strip 706, and this is achieved by fast quenching. The specific "fast quenching rate" value depends on the alloy system. The second objective is to prevent the alloying elements, which are kept in solute solution in the first segment, from creating precipitations while the strip is passing to successive phase transition regions—like "aging temperatures" during quenching/cooling process. To avoid precipitations in the strip material which is passing this lower temperature region (aging conditions), a slower quench rate can be applied as diffusion is lower compared to the high temperature region (objective 1). For example, in an AL-Si—Mg System the fast quenching condition (objective 1) can be important until the strip cools down to about 150-200° below the solidus transition temperature $T_{ST}$. At this lower temperature diffusion is slow and "fast quenching" is not required. To create and grow precipitation at temperatures at about $T_{ST}$-200° a longer diffusion time is needed, therefore the quenching rate is less critical. The different quenching conditions suggest to separating the quenching unit into two independent segments. Whereas the first quenching segment is vertical because of higher absolute temperatures (allow low tension in the strip, avoid touching of rolls, symmetric cooling). Here, higher quenching rates are needed. Also, a specific quenching media supporting excellent heat transfer are applied in the first unit. The second quenching segment 761 could be arranged in a horizontal manner or in an inclination to allow a compact line design as shown in FIG. 7. Because of lower strip temperatures, deflection rolls can be used to guide the strip. A single deflection roll 772, or s-roll, or 2 s-rolls can be used to lead the strip from a vertical to a horizontal pass line. The deflection roll might be lubricated with a medium to avoid scratch and improve heat transfer/heat dissipation 765. The deflection mechanism might be integrated in the second quenching segment to avoid a situation where no cooling is applied to the strip (avoid surface reheating & segregation, clustering). The cooling method in these two distinct quenching segments can be designed for its specific purpose. For the second quenching segment, simple air cooling would be sufficient, however any other quenching scheme is applicable. Respectively an economic quenching method as a water or oil basin could be applied. The basin containing a specific medium, preferably water or oil might be heated to ensure a specific exit temperature. The quenched strip can be passed through opposing rolls 766 and recoiled into a heat treated and quenched coil 780.

An alternate solution instead of the two-segment quenching arrangement may be a single basin as shown in FIG. 8A in which the heat treated strip 106 output by the first furnace 100 is led through the basin 465 in the quenching unit 405 containing an inert liquid media, like a customized quenching oil. The oil bath supports high quenching rates, inert cooling milieu and defined exit temperature. Optionally, the flow of the liquid cooling media is designed in a backflow manner, where the media is re-cooled and filtered in a close loop. A heat exchanger can be used to maintain optimum cooling conditions of the cooling media. The orientation of the strip 106 outputted through an outlet in the housing 110 of the first furnace 100 can be redirected from a substantially vertical orientation to a substantially horizontal orientation by a first deflection roll 472 and the substantially horizontal orientation of the quenched strip 406 can be changed by a second deflection roll 473 to a substantially vertical orientation. A third deflection roll 474 can change the substantially vertical orientation of the quenched strip 406 to a substantially horizontal orientation.

As shown in FIG. 8B, the shape of the container might be shaped in the way to substantially minimize the liquid cooling media volume. During the first phase of the quenching process at higher temperatures, the heat-treated strip 106 surface should not touch any other equipment components like rolls to avoid surface defects. However, below a specific temperature $T_{MC}$ depending on gauge and alloy (for example <400° for 6xxx series) the strip surface is robust enough to be in contact with deflection rolls without risk of mechanical surface defects. Further, the oil in the basin acts as lubricate reducing any remaining risk for surface defects. The deflection rolls usually introducing uneven local hardening in the strip. This resulting internal tension caused by the "levelling deformation" will be minimized as the strip is exposed to a temperature load during cooling (e.g. for 6xxx alloys: $\Delta T \approx 100\text{-}500°$ C., $\Delta t \approx 10\text{-}60$ s) according to the temperature profile in the cooling process. With reference to FIG. 8B, the orientation of the heat treated strip 106 outputted through an outlet in the housing 110 of the first furnace 100 can be redirected from a substantially vertical orientation to a different orientation by a first deflection roll 572 and then the quenched strip 406 orientation can be changed by a second deflection roll 574 to a substantially horizontal orientation. The quenching unit includes first and second quenching segments 562 and 567 comprising opposing nozzles to spray a quenching medium into the strip to form sequentially first partially quenched strip 561 and second fully quenched strip 566.

Optionally a short air quenching unit with length typically <1.5 m is positioned after the furnace 1 exit and before the basin with liquid quenching media. This might be adventurous if the quenching media could react with the sheet surface at high strip annealing temperatures, e.g. creating undesired stains on the surface.

Optionally an additional heat treatment (multistep) by induction can be applied between heat treatment furnace and quenching unit to modify the temperature profile. This would enable a multistep-step annealing procedure to customize alloy properties. The multistep unit typically rises the temperature for a short time (30-45 s) to higher temperatures. The length of the unit depends on the line speed, it would be typically between 1-5 m in length.

Strip Management after Quenching

After quenching the sheet article is cooled down, typically down to temperatures close to ambient temperature. In the cooled condition, a sheet is typically less sensitive to mechanical contact and/or atmospheric influence than a heated sheet article. The quenched sheet may be recoiled immediately after quenching with no additional treatment/processed step in between. A re-coiler may be arranged below the first furnace, for example.

It is also possible to provide a deflecting unit to deflect sheet from a vertical orientation to an oblique or horizontal orientation after quenching. In this case the quenching unit is preferably arranged between the outlet port and the deflecting unit so that the sheet is deflected only after quenching in a relative insensitive condition. In this case, a re-coiler may be arranged next to the first furnace in an appropriate position.

It is possible to provide one or more additional treatment units between the quenching unit and a re-coiler so that successive portions of the quenched sheet article may be subjected to one or more additional heated treatment operations and/or other operations prior to recoiling. For example, stabilizing or aging operations may be performed prior to recoiling. To stabilize the material the coil can be heat treated with conventional means at typically about 70-120° C. (preferably about 80-95° C.) and re-coiled at this temperature. Also, preferably the coil (steel) cores are preheated at the same temperature (about 70-95° C.) to prevent cooling of the inner windings of the coil.

Alternatively, the steel cores are thermally insolated, or the core is of a material of low heat-conductivity.

Another module after quenching are a leveling or stretch-leveling unit which applies a defined low forming tension/bending operation on the sheet (strip). The low forming can be applied at (A) room temperature or (B) elevated temperature (typically about 90-220° C.) depending on the quenching strategy. The defined deformation process improves flatness of the strip which might be distorted because of the prior quenching process. The forming at elevated temperatures might be favorable because less strain hardening occurs, and therefore less internal tension will be introduced in the sheet.

Another module after quenching is a pair of working rolls; layout can be as Quadro (back up roles) or as a duo layout. The rolling applies a skin pass of typically 2-6% to create a defined surface topography. The topography of the working rolls is preferably stochastic (Electro-Discharge-Texturing, Shoot-Peening) but could be as well Mill Finish or Laser-Tex. The working rolls are transferring the topography to the sheet metal (textured sheet topography). The surface texture can be applied at room temperature (RT) or at elevated temperatures (typically about 120-220° C.). Elevated temperatures reduce the effect of strain hardening during the skin pass and the strip remains closer to the soft temper required for good formability performance.

Conventionally the textured surface is applied in the last cold mill pass of standard sheet metal production. The quality of the surface replica depends on speed, oils, reduction and temperature. The arrangement of the skin pass in-line of the proposed heat treatment process provides several advantages as the typical parameters (slow speed, adaptable temperature, low reduction) of the proposed heat treatment line are favorable for transferring a topography texture from working roll to sheet (e.g. EDT). The advantages can include: (A) cost efficiency, because a (slow, typical <100 m/min) off-line skin pass (typically <10% reduction) in a full-size cold mill "consumes" significant "cold-mill-time". The capability of a cold mill is typically about 40-60% reduction at high speed (about 500-1800 m/min). (B) A skin pass at elevated temperature provides a better replica from the working roll surface topography to the sheet surface, the applied temperature depends on the metallurgical strategy, e.g. the skin pass takes place in the range of 70–120° C. (in combination with stabilization in 6016/6011/6014/6009 alloys) or at 120-250° C. to condition the intermetallic phases of other heat treatable alloy.

The method and system can allow performing thermal treatment of aluminum alloy sheets with unusual combinations of relatively long annealing/heat-treatment times and subsequent quenching with relatively fast quenching rates. An example of unusual soak time and quenching rate combinations possible with the disclosure, but not practical in prior art systems, are systems with slow growth/dissolution of precipitations like (Al)x-(Me1)y-(Me2)z (slow diffusion), or more constituents whereas x,y,z are digits describing the ratio of the element Al, Me1 or Me2 in the phase. In technical alloys the phase may contain of more than 2 other Metals, like Me3, Me4, and further.

In those alloys the precipitations can be processed and maintained at ultrafine scale below 15 microns or much smaller into the sub-micron region. For example, alloys and process building precipitation in the Nano scale are described in U.S. Pat. No. 9,453,272. Usually these alloys require a minimum solidification rate to avoid that the hardening constituents precipitated during cast in coarse condition. Therefore, those concepts are applied to continues cast technologies like Twin Roll caster, block caster or Hazlet caster. A later dissolvement during the sheet manufacturing process of the coarse particles need very long solid solution annealing times which are difficult to achieve in conventional heat treatment technologies. The proposed batch anneal quenching process can allow flexible soak time above solute solution temperature which is essential the processes e.g. described in U.S. Pat. No. 9,453,272 and enables to process this kind of alloy design in conventional DC (Direct Chill) flow path. In this DC process route the ingots are casted typically to about 500-600 mm at slow solidification and cooling rates. The slow solidification/cooling generates coarse precipitations which must dissolved to permit later processing into the described ultrafine microstructure. The long solid solution treatment times can be achieved by the embodiment.

The method and system enable heat treatment cycles on coiled sheet material from a thickness range including thicknesses which are greater than maximum thicknesses of coiled sheet material in prior art processes. For example, nowadays sheets with gauges in the order of 6.5 mm or more are typically processed in thin plate format to allow for homogenous heating & quenching in conventional plate furnaces. However, in the new process and system, the soak time in the first furnace and/or in the first temperature range is no longer a limiting factor to the process, and homogenous heating can be obtained even when thicker material is formed into a coil. In some processes the sheet article is rolled to a gauge between about 6.5 mm and about 12 mm (15 mm) prior to coiling. The coil formed by this relatively thick sheet material is then inserted into the first furnace, heat treated for sufficient amount of time, and subsequently quenched in a continuous quenching operation.

The predetermined gauge from which the coil is formed may range, for example, from about 1 mm to about 12 mm (15 mm). Typical width of the strip depends on the desired end use of the sheet. For example, sheets intended for use in automotive industry to form panels or the like may have a width up to 2300 mm. Larger widths, for example, up to 3000 mm, may be possible for other applications. Lower limits for width are for special applications e.g. can body.

The sheet strip which has been coiled after initial processing steps is then subjected to heat treatment including heat treatment at elevated temperatures significantly above room temperature (e.g. more than 350° C., see table) and subsequent quenching or cooling, typically to temperatures as low as room temperature. The term "room temperature" as used herein refers to temperatures in the range from about 10° C. to about 50° C.

(De-Coiling and Quenching Station)

The system and method of the disclosure can be particularly beneficial for intermediate annealing (IA) as an intermediate annealing process takes place at higher gauges before further cold rolling passes:

1. Solid solution heat treatment at intermediate gauge
2. Cold rolling to create high driving force and nucleolus (e.g. dislocations) to enhance ultrafine precipitations
3. Precipitation hardening (aging)

FIG. 1A shows schematically components of a system of manufacturing aluminum alloy sheet according to an embodiment of disclosure. The components include a first furnace 100 comprising a housing 110 enclosing a furnace room 112 dimensioned to receive no more than one single coil 102 at a given time. The strip material 106 is coated with a substance which is capable to separate the windings of the strip material when winded into a coil form. The housing 110 includes thermal insulation. Heating devices to actively heat the interior of the housing to a temperature as high as about (250° C.) 350° C. to about 650° C. (for non-aluminum, sheet material higher), for example, may include electric heaters and/or gas heaters for direct or indirect gas heating. An atmosphere control system may include devices capable of providing a controlled atmosphere in the furnace room. Specifically, a dry atmosphere with low moisture content may be preferred in various processes.

An input port 130 dimensioned to receive a complete coil into the furnace room is provided in one side wall of the housing. In other embodiments, an input port may be provided at a different location, e.g. on the top/back side of the furnace.

The coil is inserted into the furnace room with the coil axis 104 being oriented essentially in a horizontal direction. The aluminum alloy strip 106 of the coil is held on a tube-like carrier forming the core of the coil. A holding structure 140 comprising a rotatable coil support within the furnace room is configured to hold the coil within the furnace so that the coil may be rotated about the coil axis when held in the furnace room. A coil rotation drive 145 situated outside the furnace room is provided to actively rotate the coil about the coil axis while the coil is in the first furnace. The coil drive is connected to the carrier holding the coil via appropriate transmission devices.

The method according to the disclosure includes steps wherein successive portions of the strip of alloy sheet are uncoiled from the heated coil while a remaining portion of the heated coil remains in the first furnace. An outlet port 150 spatially separated from the input port 130 is provided on a bottom side of the first furnace.

The outlet port (see enlarged detail in FIG. 1) provides an opening 152 through which successive portions of the sheet strip 106 may exit the furnace room towards the outside of the first furnace when the heated coil is rotated counter-clockwise in the embodiment. The outlet port shape and size are adapted to the sheet cross-section so that a minimal lateral spacing (typically a few millimeters or centimeters) remains on all sides between the surface of the sheet and the inner edges of the structures delimiting the opening of the outlet port. In general, the outlet port opening 152 may have a slit-like rectangular shape. A set of mutually perpendicular movable blinds may be provided to delimit the opening size of the outlet port so that the opening size can be adapted to any desired width and height depending on the cross-sectional shape of the sheet.

During de-coiling the axis of the coil is moved by a mechanical scheme 155/156 to keep the coil vertical to the output port. After feeding the coil into the outlet port 152 and is guided by the successive guiding apparatus the feeding mechanism 155/156 might be moved away from the strip.

To start the process a strip guiding mechanism is applied to feed the strip through the output port respectively the following components.

A quenching unit 160 is provided immediately below the bottom wall of the first furnace. The quenching unit may comprise one or more pairs of spray units 162 configured to spray or flood a cooling fluid 161, such as cold water and/or a gas, on either side of the sheet article as soon as the respective portion of the sheet has exited the furnace room through the outlet port. Optionally the spray could be conditioned in a separate unit. The conditioning is in the kind that a defined size distribution of the media and certain temperature range of the media is generated and then directed onto the strip for an even and well-defined quenching purpose. This has two impacts, improving homogeneity of quenching conditions across the product and enables metallurgical in-situ treatments (quench to temperature, pre-nucleation of desired phases).

The passages provided by the outlet port and the quenching unit are positioned relative to the perimeter of the coil 102 so that successive portions of the sheet strip uncoiled from the perimeter of the coil in a vertical uncoiling direction (arrow) can pass freely through the outlet port 150 and between the spray devices 162 of the quenching unit 160, with excess cooling fluid 160 being captured by reservoir 168 before output of the quenched strip from the quenching unit 160. The uncoiled hot strip of aluminum alloy may thereby hang freely from the perimeter of the coil until the material is quenched by the quenching unit. In this arrangement, the gravitational force is acting in the preferred vertical direction as no supporting force (e.g. air like in conventional strip lines) or rolls (e.g. in plate flow path) are needed to keep the coil in the preferred direction An optional pair of guide rollers 166 may be provided downstream of the quenching unit to prevent the hanging sheet from being blown sideways by the spray devices of the quenching unit. The guide rolls may be synchronized with the coils drive in first furnace to support the feed through the cooling unit. A deflecting unit 170 symbolized by a single deflecting roller is arranged below the quenching unit 160 to deflect the quenched sheet from the vertical orientation to a substantially horizontal orientation so that a recoiling unit 180 may be arranged on the level of the deflecting unit.

To keep the strip centered in the cooling unit two options are possible:

1. Manipulating the coil in the first furnace that the outer perimeter of the coil is located at a constant vertical position to the outlet port (quenching gap position). A drive 145 manipulates the coil accordingly.
2. The opening port, quenching unit and defection roll are positioned in a vertical line with the outer coil perimeter. The above-mentioned components might be mounted on a frame 175 which can be synchronized with the vertical coil perimeter position in first furnace, such as shown in FIG. 1B.

With reference to FIG. 1C, one or more processing or treating operations may be performed to change the properties of the quenched sheet material before this strip is recoiled in the recoiling unit 180. Additional treatments may include: Stabilization of the product, what means a pre-nucleation of the desired phases which is typical process in conventional continuous heat treatment lines. The desired phase will be fully developed in the aging process at a later stage, typically after forming the sheet product into a 3D component. The stabilization heat treatment will also ensure persistent age hardening response (shorter production cycle in downstream aging process, respectively enabler to meet curing process in automotive body in white paint shop process (typically 20 min, 175° C.).

In a process of manufacturing aluminum alloy sheet from a strip of aluminum alloy a coil 102 is inserted into the first furnace 100 and heat-treated for a predetermined period of time (first soak time) at elevated heat-treating temperatures in a first temperature range. After the material has reached the desired first state of microstructure and/or composition, successive portions of the sheet article are un-coiled from the heated coil while a remaining portion of the heated coil remains in the first furnace. In the embodiment, uncoiling is affected by activating drive 145 to rotate the coil 102 counterclockwise so that the outer layer of the coil will travel towards the outlet port 150 on the bottom side of the first furnace upon rotation of the coil. The rotational speed provided by the drive 140 is adapted to the instant diameter of the coil so that the transport direction with which the successive portions of the sheet travel towards and through the outlet port stays constant independent of the diameter of the remaining coil. Successive portions exiting the furnace room through the outlet port are continuously quenched by the quenching unit 160 immediately after exiting the furnace room through the outlet port. The cooled-down portions of the strip are then guided through the guide roller 166 and deflected by the deflecting unit 170 towards the recoiling unit 180 provided with a separate drive. The strip is driven (pushed) by uncoil drive and pulled by driver roles after quenching in a manner that the aluminum strip (metal strip) experienced minimum (close to zero) tension. Like described before, the low force allows higher temperatures closer to solidus in combination with a multi-step heat treatment circle (i.e. cycle) in the furnace array of two or more furnaces.

To guide the coils safely through the cooling section, the edges of the downward moving strip might be guided by a side dam 165. The side dam material consists of high temperature low friction material or a system of rolls. It might be stationary or moving with the strip product.

Optionally a blow off system 168 might be installed after quenching to remove cooling agents from the strip.

The elements limiting the opening 152 of the outlet port 150 are mounted to be movable in a horizontal direction to move the outlet port synchronously with the rotation of the coil 102 so that the vertical portion of the sheet is always in the center region of the outlet port as the diameter of the coil decreases with progressive uncoiling. Likewise, the elements of the quenching unit 160, the guide rollers 166 and the deflecting roller 170 are mounted to be movable in the horizontal direction so that a common tangent to the perimeter of the coil 102 and the deflecting unit 170 remains in a vertical plane.

In another embodiment the outlet port, the quenching unit and subsequent units may remain stationary and the coil support structure within the first furnace is configured so the coil axis may be moved closer to the vertical plane through the output port as the uncoiling process proceeds. Mechanism to center the outer periphery of the coil in the first furnace 100 at the exit slot for the coil (downward toward the quenching unit. This ensures precise strip positioning (stable vertical pass line).

An alternative design of the cooling unit is pictured in FIG. 8A and FIG. 8B. FIG. 8A shows a quenching basin 405 containing a liquid media 465 (oil, water, liquid salt bath, . . . ) is used to quench the strip 106/406. The deflection rolls 472 redirects the strip to a horizontal position, whereas the deflection roll 473 directing the strip upwards out of the quenching basin 405. The deflection roll 474 brings the strip in an horizontal position outside of the quenching unit where the strip can be processed in optional equipment. This optional equipment might include:

- Brush system 476 to clean the surface from any stains and surface defects. The brush system is preferably abrasive and removes material from the strip surface of typically 5-40 microns.
- A stretch levelling or skin pass unit 477 to condition the shape or surface topography of the strip
- An additional furnace 490 to condition the metallurgical conditions of the strip The re-coiling unit 480 brings the heat-treated strip into coil form.

The FIG. 8B reveals a derivative of the principles of 8A. The quenching basin 505 is V-shaped to optimize the amount of cooling agent 565 and allow an easier coil feeding mechanism to feed the strip in the system before operation in quenching mode. A guiding system 561/562 (e.g. guiding rolls, or guiding sheets) feeds the strip towards the defection roll 572. To bend the sheet around the deflecting roll another guiding system can be applied (e.g. guiding rolls, or guiding sheets). In the exit part of the basin a guiding system 566/567 is applied in a similar way. Once the sheet is hold by a pinch roll outside the quenching unit the three guiding systems (entry, deflection roll, exit) can be moved away from the strip pass line 562, 503,567.

FIGS. 2A-B show schematic top views of components of systems according to other embodiments of the disclosure. Elements identical or substantially like components shown in FIG. 1 are designated by the same reference numerals, increased by one hundred. The numbering of furnace 1 is kept the same (copy) (e.g., the first furnace 100 in FIG. 1A is the first furnace 200 in FIGS. 2A and 2B and so on).

With reference to FIG. 2A, the schematic top view shows a first furnace 200 with a coil 202 loaded into the furnace room and held by appropriate coil support structures with horizontal coil axis 204. A quenching unit 260 situated below the first furnace is drawn in dashed lines. In a level below the first furnace next to the first furnace there is a recoiling unit 280. A number of processing units (dashed lines) may be provided between the deflecting and the recoiling unit 280 as shown in FIG. 1C (e.g., stretch leveler 177 and stabilization anneal unit 190) and FIG. 1D (e.g., skin pass unit 170 and stabilization anneal unit 190).

A second furnace, respectively an array of furnaces ($3^{rd}$, $4^{th}$, . . . ) might be installed to preheat the coils to utilize the first furnace in a semi-continues manner. The array of furnaces might be arranged to the first furnace in at least two different ways:

(A) in direction of the coil face as shown in FIG. 2A and (B) Perpendicular to the coil face as shown in FIG. 2B.

In the below description it is referred to case (A) where the coils are fed in direction of the coil face into the first furnace.

A second furnace 210 having outer and interior dimensions similar or identical to the respective dimensions of the first furnace 200 is arranged next to the first furnace in the direction of the coil axis 204. The input port 230 of the first furnace is provided in the side wall facing the second furnace 210 so that the coil axis runs through the input port. A transfer lock 231 thermally insulated from the surroundings is provided between the interior of the second furnace 210 and the interior of the first furnace 200. An elongated guide rod 204 extends horizontally through the first and second furnaces. While a first coil 202 may be held in the first furnace for a final phase of heat treatment and subsequent uncoiling and quenching, the second furnace may, at the same time, contain a second coil 212 which is pre-heated in the second furnace prior to insertion into the first furnace.

A third furnace 220 may be provided in-line with the first and the second furnaces to provide a third furnace room for heat treatment in a third temperature range. (e.g., for heterogenization or homogenization). The array of furnace enables increased productivity, so that the strip speed in the quenching unit is synchronized with the metal volume provided in the array of surfaces.

A heat-treatment cycle performed on a heat-treatable aluminum alloy using this embodiment may be performed as follows.

The alloy may be one of the major aluminum alloy systems exhibiting precipitation hardening. These alloys include aluminum-copper (Al—Cu) systems with strengthening from CuAl2, aluminum-copper-magnesium (Al—

Cu—Mg) systems where magnesium intensifies precipitation, aluminum-magnesium-silicon (Al—Mg—Si) systems with strengthening from Mg2Si, aluminum-zinc-magnesium (Al—Zn—Mg) systems with strengthening from MgZn2 or aluminum-zinc-magnesium-copper (Al—Zn—Mg—Cu) systems. Each of the alloys may include one or more minor additional elements in addition to aluminum and the major additions. Further the alloy may be of a kind with slower diffusion characteristics compared to the above-mentioned systems as containing amounts of Zr, Ag, Sn or Sc respectively other rare earth metals as small additions (<0.5%), preferably 0.05 to 0.4% for Zr respectively 0.01-0.2% for Sc to conventional NHT and HT alloys. The mentioned elements can be added individually or in a combination. Where Zr has the highest content up to 0.45%, Sn up to 0.25% and Sc up to 0.15%. The addition of the above elements is beneficial in commercial heat-treatable alloys as well as in commercial non-heat-treatable alloys like 1xxx, 3xxx and 5xxx. Those usually non-heat treatable system become heat-treatable by the above additions (gaining significant strength in an aging process, building precipitations).

To take advantage of the precipitation hardening reaction, it is necessary first to produce a solid solution. The process by which this is accomplished is called "solution heat treating", and its objective is to take into solid solution the maximum practical amounts of the soluble hardening elements in the alloy. The process includes soaking the alloy at a temperature ("soak temperature") sufficiently high and for a time ("soak time") long enough to achieve a nearly homogeneous solid solution.

When defining the soak temperature care must be exercised to avoid exceeding the initial eutectic melting temperature of the alloy. If perceptible eutectic melting occurs as a result of overheating, properties such as tensile strength, ductility and fracture toughness may be degraded. The lower temperature limit should, when possible, be above the temperature at which complete solution occurs (solvus temperature). Practically, under production conditions, the temperature interval for solution heat treatment provides a margin to safeguard against eutectic melting and a cushion on the low side for increased solution and diffusion rates.

The time at the nominal solution heat-treating temperature (soak time) required to allow a satisfactory degree of a solution of the undissolved or precipitated soluble phase continuance and to achieve good homogeneity of the solid solution is a function of microstructure before the solution heat treatment.

Advantages of the above system and method include: scalability of volume according to demand and market opportunity; low initial capex and operational cost; decoupling of heating and quenching allows improved performance of conventional alloys and enables novel hardening concepts; vertical quenching enables the treatment of high gauges; and low speed allows the integration of other slow running treatments

EXPERIMENTAL

The following examples are provided to illustrate certain embodiments of the disclosure and are not to be construed as limitations on the disclosure, as set forth in the appended claims. All parts and percentages are by weight unless otherwise specified.

Electrical Vehicles (EV) floor plates are protecting the battery pack from obstacles underneath the vehicle. Therefore, the plate-material needs to mechanically strong as well as ductile to avoid cracks which could create sharp sheet fragments cutting into the battery cell structure. The protective plates are typically in gauges of 4.5-6.5 mm of heat-treatable 6xxx alloys (HT) or non-heat-treatable 5xxx alloys (NHT). An improvement regarding strength/ductility ratio can be achieved by combining 5xxx base alloy with the previously described ultra-fine precipitation method. The gauges required in EV floor plates are unfavorable for conventional continuous strip annealing lines as well as in "piece by piece" plate processing or batch annealing used for NHT alloys. The proposed process enables more consisted properties at lower cost Specific example of preferred heat-treating cycles for a 6016 alloy at high gauge:

1. Feed stock (Al-coil), hot rolled or cold rolled condition at 6.5 mm gauge (thickness)
2. Heating time in second furnace 2 h-4 h/520° C.
3. Soaking time in first furnace 15 min/550° C.
4. Quenching condition, (a) quenching rate: de-coiling speed≈10 m/min, (b) target temperature T≈100° C.
5. Skin pass to create EDT surface with 5-10% at T≈90° C. to 95° C.
6. Coiling at temperature at about T≈90° C.
7. Optionally stabilization annealing in third furnace at T≈90° C. to 95° C. if required Specific example of preferred heat-treating cycles for a 6016 ultra-high strength alloy for battery box floor plate:

1. Feed stock (Al-coil), hot rolled condition at 8 mm gauge (thickness)
2. Heating time in second furnace 2 h-4 h/520° C.
3. Soaking time in first furnace 20 min/550° C.
4. quenching rate: de-coiling speed≈8 m/min
5. Coiling at temperature at about T≈80° C.
6. Cold rolling from 8 mm to 5 mm gauge
7. Optionally cut to length
8. Age hardening at 205° C./15 min (soaking time)

Specific example of preferred heat-treating cycles for a 5182 with ultra-fine precipitations for structural components:

1. Feed stock (Al-coil), hot rolled condition at 4.5 mm gauge (thickness)
2. Heating time in second furnace 2 h-4 h/520° C.
3. Soaking time in first furnace 30 min/550° C.
4. Quenching rate: de-coiling speed≈30 m/min
5. Coiling at temperature at about T≈70° C.
6. Cold rolling from 4.5 mm to 1.5 mm gauge
7. Annealing to any required temper. For example: Soft annealing at 350° C./3 h Specific example of preferred heat-treating cycles for a 8076 based alloy containing heat-treatable ultrafine precipitations for high strength foil.

1. Feed stock (Al-coil), hot rolled condition at 3 mm gauge (thickness)
2. Heating time in second furnace 2 h-4 h/520° C.
3. Soaking time in first furnace 30 min/550° C.
4. Quenching rate: de-coiling speed≈30 m/min
5. Coiling at temperature at about T≈70° C.
6. Cold rolling from 3 mm to 0.5 mm gauge
7. Intermediate annealing at 300° C., continuous 20 s (alternatively batch annealing 2 h)
8. Cold rolling to foil gauge at 45 microns
9. Age hardening at 400° C./20 min (soaking time)

A number of variations and modifications of the disclosure can be used. It would be possible to provide for some features of the disclosure without providing others.

The present disclosure, in various embodiments, configurations, or aspects, includes components, methods, processes, systems and/or apparatus substantially as depicted and described herein, including various embodiments, configurations, aspects, sub-combinations, and subsets thereof. Those of skill in the art will understand how to make and use the present disclosure after understanding the present disclosure. The present disclosure, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease and\or reducing cost of implementation.

In an aspect of the disclosure, a method of manufacturing aluminum alloy sheet can include one or more of the steps: providing a sheet article at a predetermined gauge capable of forming a coil, the sheet article made of an aluminum having a major content of aluminum and a minor content of one or more additional elements; forming a coil from the sheet article; inserting the coil into a first furnace; heat treating the coil in the first furnace at elevated heat-treating temperatures in a first temperature range so that the aluminum alloy approximates a first desired (equilibrium) metallurgical state; uncoiling successive portions of the sheet article from the heated coil while a remaining portion of the heated coil remains in the first furnace; guiding portions of the sheet article uncoiled from the coil out of the first furnace; continuously quenching the portions of the sheet article uncoiled from the coil after guiding the portions out of the first furnace. The aluminum alloy can be a heat-treatable aluminum alloy in main but not restricted to heat-treatable alloys.

The method can further include the steps of pre-heating the coil in a second furnace in a second temperature range prior to inserting the coil into the first furnace; transferring of the coil from the second furnace to the first furnace. The preheating can include an array of furnaces. Preheating can operate in a protective gas, or chemically inert, atmosphere. Temperature sensitive drives can be located outside the heated furnace area.

The coil can define a coil axis, with the coil being held in the first furnace with a horizontal coil axis. The coil can be transferred in a transfer direction essentially parallel to the coil axis when transferred from the second furnace to the first furnace via a long guide rod extending from second to first furnace. Alternatively or additionally, the coil can be transferred perpendicular to the horizontal coil axis into the first coil by a transport mechanism.

The coil can have optionally a high temperature stable lubricant applied before the coil goes in furnace. The lubricant can be silicon or carbon base, similar formula as used in hot forming of Al sheet (QPF, SPF). The lubricant can be based graphene or graphene oxide, preferably a cured suspension of flakes commercially available.

Successive portions of the sheet article can be guided from a perimeter of the remaining portion of the heated coil in an uncoiling direction tangential to the perimeter through an outlet port of the batch annealing furnace. The uncoiling direction can be a vertical direction and the outlet port can be on a bottom side of the first furnace. The first furnace can include or contain a guiding system to feed the coil into the quenching unit. At least one of the coils can be moved during uncoiling of the coil such that a vertical portion of the sheet article running tangential to the perimeter of the coil is always running through the outlet port. Quenching can be performed by applying quenching fluid to successive portions of the sheet article immediately downstream of the outlet port.

The furnace can include an outlet port in communication with a quenching unit and deflection roll that move synchronously with the vertical strip position as the strip is uncoiled from the perimeter of the coil in first furnace. In this alternative case, the axis of the coil in the first furnace remains in a constant position.

A deflecting unit can deflect the sheet from a vertical orientation to a horizontal orientation when the sheet is already partly or fully quenched and insensitive to surface defects.

Successive portions of the quenched sheet article can be subject to an additional heat treatment after quenching (stabilizing, aging). The successive portions of the quenched sheet can be subject to stretching at elevated temperature (75-250° C.)

A maximum temperature during solution heat treatment in the first temperature range can be at least 5° C. lower than a solidus temperature of the aluminum alloy. (overheating can be avoided, heated sheet article mechanically more stable, less sensitive on the surface).

Novel combinations of (long) annealing time and (fast) quenching rate can be realized by the method. Those combinations include not only in 2xxx and 7xxx alloys, but also in 6xxx alloys at higher gauges. In particular, it is an enabler for alloys revealing a ultra-fine microstructure with one or more precipitating phases where at least one of the phases is processed below about 10 microns, preferably below about 1 micron. Those alloys typically containing small additions (<0.5%) of Zr, Sn, Ag or Sc respectively or other alloy additions promoting extremely fine precipitation requiring long annealing times.

Prior to coiling the sheet article is rolled to a gauge between about 6 mm and 12 mm and consist of a HT or NHT alloy. The gauge range is very unfavorable from a technical and commercial perspective for heat treating/annealing in plate format (too thin gauge) aa well as in continuous heat treating/annealing (too high gauge)

In another aspect of the present disclosure, a system for aluminum alloy sheet heat treatment includes: a first furnace comprising a housing enclosing a furnace room dimensioned to receive a coil formed from the sheet article, the housing comprising an input port dimensioned to receive the coil into the furnace room and an output port (separate from the input port) for outputting successive portions of the sheet article uncoiled from the coil; and a quenching unit arranged downstream of the output port in a transportation direction of successive portions of the sheet article uncoiled from the coil, the quenching unit configured to continuously quench successive portions of the sheet article guided through the quenching unit (output port size adapted to sheet cross section, e.g. 100 mm*2,300 mm (max width in transportation sector up to 3,000 mm).

A rotatable coil support in the first furnace can be provided so that the coil may rotate about coil axis while successive portions of the sheet article are uncoiled from the coil. A coil rotation drive actively rotates the coil about a coil axis while in the first furnace. The coil uncoils automatically, zero or very low drawing force on annealed sheet required. The coil axis is oriented horizontally The first furnace can include a furnace room dimensioned to receive only one coil at a time.

A maximum temperature during solution heat treatment in the first temperature range can be at least 5° C. lower than a solidus temperature of the aluminum alloy. Overheating can be avoided by two-step heat treatment, heated sheet article mechanically more stable because of low tension in strip, less exposed to surface defects because deflection and guiding rolls are minimized in the heat section between uncoiling from first furnace to exit of quenching unit.

The outlet port can be on a bottom side of the batch annealing furnace.

The quenching unit can be arranged below the first furnace.

The quenching unit can be arranged between the outlet port and the deflecting unit.

The quenching can be performed by applying agent (gas, fluid, moist, steam) to successive portions of the sheet article immediately downstream of the outlet port.

The quenching unit can apply a spray system and/or a tank system for quenching.

A guiding system can be arranged in the quenching unit in either quenching method.

The cooling agent applied in the quenching unit could be in form of gas, liquid or any combination thereof. The cooling agent applied in the quenching unit can be hot rolling emulsion, particularly in combination with hot skin pass. The cooling agent applied in the quenching unit can be preheated to ensure a more consistent heat transfer across the successive portions of the strip (across width and length). The cooling agent applied in the quenching unit can be preconditioned before feeding into the spray nozzle.

A blow off unit can be arranged after the quenching unit to reduce the amount of quenching agent on the strip.

A guiding roll can be arranged after the quenching unit.

A dressing roll can be arranged after the quenching unit.

A deflecting unit can be included to deflect sheet from a vertical orientation to a horizontal orientation. The strip is deflected when already quenched, fully (RT) or partially (intermediate temperature) and relatively insensitive to surface defects.

Alternatively or additionally, a dressing roll can be arranged after the deflection roll unit.

A skin pass (dressing roll) after quenching might be applied, before or after deflection roll. A skin pass can improve the strip flatness as distortion results from quenching and prior cold rolling. A stochastic surface structure can be applied by embossed skin pass working rolls. The strip might be quenched to RT, but preferably to an elevated temperature (about 75-250° C.) to improve pattern replication from working roll to Al-sheet surface. The elevated temperature skin pass can allow metallurgical treatments while applying the skin pass. E.g. regarding IP nucleation, clustering and stress relaxation.

Stretch levelling, or levelling process, can be applied after deflection roll. The strip might be processed at RT, but preferably to an elevated temperature (about 75-250° C.) to limit the strain hardening during leveling respectively stretch levelling. The elevated temperature levelling process can allow metallurgical treatments while straightening the strip, e.g. regarding IP nucleation, clustering and stress relaxation.

A third furnace can be installed to perform a final annealing or heat treatment.

The strip can be brushed before coiling to remove any residuals from annealing and quenching process. The brush can be abrasive typically up to about 30 microns. Furthermore, the brush can remove defects from casting (e.g. black strikes), or defects from hot mill (pick up).

The different components discussed above are optional and are applied depending on the targeted specification of the final product respectively the incoming strip quality.

An integrated strip feeding system can be provided to feed the strip (1) through a furnace exit port, a true quenching system, through dressing roll, leveling unit, and/or stabilization heat treatment furnace.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more embodiments, configurations, or aspects for the purpose of streamlining the disclosure. The features of the embodiments, configurations, or aspects of the disclosure may be combined in alternate embodiments, configurations, or aspects other than those discussed above. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate preferred embodiment of the disclosure.

Moreover, though the description of the disclosure has included description of one or more embodiments, configurations, or aspects and certain variations and modifications, other variations, combinations, and modifications are within the scope of the disclosure, e.g., as may be within the skill and knowledge of those in the art, after understanding the present disclosure. It is intended to obtain rights which include alternative embodiments, configurations, or aspects to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A method of manufacturing aluminum alloy sheet comprising:

pre-heating a coil of aluminum alloy sheet in a second furnace in a second temperature range prior to inserting the coil into a heat-treatment furnace;

transferring, while the pre-heat-treated coil is fully coiled, the pre-heat-treated coil from the second furnace to the heat-treatment furnace;

heating, in the heat-treatment furnace and at an elevated first temperature, the pre-heat-treated coil to form a heat-treated coil, wherein the first elevated temperature is selected so that an aluminum alloy of the aluminum alloy sheet approximates a first metallurgical state, and wherein a heat-treated portion comprises heat-treated portions successively uncoiled from the heated coil;

while at least a portion of the heat-treated coil remains in the heat-treatment furnace:

uncoiling a heat-treated portion of the aluminum alloy sheet from the heat-treated coil;

passing the uncoiled heat-treated portion of the aluminum alloy sheet through an outlet of the heat-treatment furnace, wherein the uncoiled heat-treated portion, immediately before quenching, has a temperature within about 10° C. of the elevated first temperature and has a temperature at least about 20° C. below a solidus temperature of the uncoiled heat-treated portion; and continuously quenching, by a quenching unit, the uncoiled heat-treated portion to form a quenched sheet.

2. The method of claim 1, wherein the heat-treated coil is uncoiled by a temperature sensitive drive located outside the heat-treatment furnace and wherein the heat-treated coil defines a coil axis and the heat-treated coil is maintained in the heat-treatment furnace with the coil axis being substantially horizontal.

3. The method of claim 2, wherein the pre-heat-treated coil is transferred from the second furnace to the heat-treatment furnace in a transfer direction essentially parallel to the pre-heat-treated coil axis and wherein the pre-heat-treated coil is transferred from the second furnace to the heat-treatment furnace via a guide rod extending from second furnace to heat-treatment furnace and further comprising:

pre-coating a strip-surface of the pre-heat-treated coil in the heat-treatment furnace with a substance providing a separation of strip windings forming the pre-heat-treated coil, wherein the substance is stable at temperatures applied in the heat-treatment furnace and forms a barrier to prevent sticking of two adjacent pre-heat-treated coil windings and wherein an applied coating thickness of the substance on the pre-heat-treated coil ranges from about a few atom layers to about 5 microns.

4. The method of claim 2, wherein the pre-heat-treated coil is transferred from the second furnace along an axis perpendicular to the horizontal coil axis to the heat-treatment furnace by a transport mechanism, wherein a high temperature stable lubricant is applied before the coil enters the second furnace, and wherein the heat-treatment and second furnaces each comprise an inert gas atmosphere.

5. The method of claim 1, wherein the heat-treated portion is guided from a perimeter of an uncoiled portion of the heat-treated coil in an uncoiling direction tangential to a coil perimeter through the outlet of the heat-treatment furnace and wherein the uncoiling direction is a vertical direction and the outlet is on a bottom side of the heat-treatment furnace.

6. The method of claim 1, wherein the heat-treatment furnace comprises a guide system to feed the heat-treated portion of the heat-treated coil into the quenching unit, wherein the coil is moved during uncoiling of the coil such that a vertical portion of a sheet article running tangential to a perimeter of the coil is maintained in the tangential direction at an outlet of the heat-treatment furnace, and wherein the quenching unit is located outside of the heat-treatment furnace and below the outlet and further comprising:

mechanically joining an end strip of the coil to an end of a second coil when the end strip is almost completely uncoiled into the outlet towards the quenching unit, wherein the mechanical joining is done by a clamping system.

7. The method of claim 1, further comprising:

maintaining an orientation of one or both of the outlet of the heat-treatment furnace and the quenching unit substantially constant relative to an uncoiling position of the heat-treated portion when uncoiled from the heat-treated coil.

8. The method of claim 1, wherein a deflecting unit deflects the quenched sheet from a vertical orientation to provide a substantially horizontal orientation after the heat-treated portion is partly or fully quenched and substantially insensitive to surface defects.

9. The method of claim 1, further comprising:

subjecting the quenched sheet to an additional heat treatment after quenching, wherein the heat-treated portion of the quenched sheet is subject to stretching at an elevated temperature ranging from about 75 to about 250° C., and wherein the elevated first temperature is at least about 5° C. lower than a solidus temperature of the aluminum alloy.

10. The method of claim 1, wherein an exposure time of the coil at the elevated first temperature in the heat-treatment furnace is at least about 10 minutes and a residence time of the heat-treated portion in quenching is no more than about 30 seconds, wherein the quenched sheet comprises an ultra-fine microstructure with one or more precipitating phases, and wherein at least one of the one or more precipitating phases is processed below about 10 microns.

11. The method of claim 1, wherein the aluminum alloy sheet is heat treated by a heat-treatment solution-when coiled on the coil, wherein a maximum temperature during solution heat treatment is at least about 5° C. lower than a solidus temperature of the aluminum alloy sheet, and wherein the heat-treated portion is free of contact with deflection and guiding rolls between the outlet of the heat-treatment furnace and a sheet inlet of the quenching unit.

12. The method of claim 1, further comprising: applying, by the quenching unit, a quenching agent to the heat-treated portion of the aluminum alloy sheet immediately downstream of the outlet of the heat-treatment furnace, wherein one or more quenching devices of the quenching unit comprises at least one of a spray nozzle and a quench tank.

13. The method of claim 12, further comprising: directing the heat-treated portion through one or more quenching devices by a guiding system positioned in the quenching unit.

14. The method of claim 13, wherein one or more of the following is true:

a cooling agent applied in the quenching unit is in form of a gas and/or liquid;

a cooling agent applied in the quenching unit comprises a hot rolling emulsion;

a cooling agent applied in the quenching unit is preheated to ensure consistent heat transfer across a width and length of the heat-treated portion; and a cooling agent applied in the quenching unit is preconditioned before being fed into a spray nozzle of one or more quenching devices.

15. The method of claim 1, further comprising: deflecting by a deflecting unit the heat-treated portion from a substantially vertical orientation to a substantially horizontal orientation, and wherein the heat-treated portion is deflected when already partially quenched at an intermediate temperature, or fully quenched at about room temperature, or when the heat-treated portion is insensitive to surface defects.

16. The method of claim 15, further comprising: performing a skin pass by a dressing roll after quenching, wherein the dressing roll is positioned downstream of the deflecting unit, and wherein the skin pass comprises a first skin pass that improves a degree of flatness of the heat-treated portion, the method further comprising, applying a second skin pass by embossed skin pass working rolls downstream of the dressing roll.

17. The method of claim 15, further comprising: applying a low forming tension or bending operation to the heat treated portion by a stretch levelling unit downstream of the deflecting unit and wherein the deflecting unit comprises one or more deflecting rolls.

18. The method of claim 1, further comprising: performing a final annealing or heat treatment by at least a third furnace, wherein the third furnace is positioned between the heat-treatment furnace and the quenching unit, and wherein the heat-treated portion is heated when coiled on the coil in both the heat-treatment and third furnaces.

19. The method of claim 1, further comprising: removing any residuals and surface defects from the quenched sheet by a brush positioned downstream of the quenching unit.

20. A method comprising:

solution heat treating, at an elevated first temperature, a coil of aluminum alloy sheet to form a heat-treated coil;

while at least a portion of the heat-treated coil is being solution heat treated:

uncoiling a heat-treated portion of the aluminum alloy sheet from the heat-treated coil;

continuously quenching the uncoiled heat-treated portion to form a quenched sheet; and subjecting the quenched sheet to an additional heat treatment after quenching, wherein the heat-treated portion of the quenched sheet is subject to stretching at an elevated temperature ranging from about 75 to about 250° C., and wherein the elevated first temperature is at least about 5° C. lower than a solidus temperature of the aluminum alloy.

* * * * *